US007246416B2

(12) United States Patent
Duffy

(10) Patent No.: US 7,246,416 B2
(45) Date of Patent: Jul. 24, 2007

(54) SLIDINGLY ENGAGABLE FASTENERS AND METHOD

(76) Inventor: Leonard Arnold Duffy, P.O. Box 99, Hinesburg, VT (US) 05461

( * ) Notice: Subject to any disclaimer, the term of this patent is extended or adjusted under 35 U.S.C. 154(b) by 260 days.

(21) Appl. No.: 10/015,087

(22) Filed: Oct. 19, 2001

(65) Prior Publication Data

US 2003/0074771 A1 Apr. 24, 2003

Related U.S. Application Data

(60) Provisional application No. 60/288,780, filed on May 5, 2001, provisional application No. 60/241,707, filed on Oct. 19, 2000.

(51) Int. Cl.
*A44B 18/00* (2006.01)

(52) U.S. Cl. ..... 24/444; 24/452

(58) Field of Classification Search ..... 24/442, 24/444, 452, 16 R, 16 PB, 20 EE, 30.5 P, 24/30.5 R; 428/98–100; 604/391
See application file for complete search history.

(56) References Cited

U.S. PATENT DOCUMENTS

| | | | | | |
|---|---|---|---|---|---|
| 299,982 | A | | 8/1884 | Hodason | |
| 2,499,898 | A | * | 3/1950 | Anderson | 24/442 |
| 3,147,528 | A | | 9/1964 | Erb | |
| 3,266,113 | A | * | 8/1966 | Flanagan, Jr. | 24/452 |
| 3,408,705 | A | * | 11/1968 | Kaser et al. | 24/452 |
| 3,471,903 | A | * | 10/1969 | Northrup et al. | 24/306 |
| 3,484,907 | A | * | 12/1969 | Elsenheimer | 24/588.12 |
| 3,526,867 | A | * | 9/1970 | Keeler | 439/74 |
| 3,758,657 | A | | 9/1973 | Menzin et al. | |
| 4,183,121 | A | | 1/1980 | Cousins | |
| 4,521,943 | A | * | 6/1985 | Kanzaka | 24/689 |
| 4,534,733 | A | * | 8/1985 | Seigneurin et al. | 433/122 |
| 4,581,792 | A | | 4/1986 | Spier | |
| 4,775,310 | A | | 10/1988 | Fischer | |
| 4,872,242 | A | * | 10/1989 | Allan | 24/16 PB |
| 5,067,210 | A | | 11/1991 | Kayaki | |
| 5,088,162 | A | * | 2/1992 | Allan | 24/442 |
| 5,179,767 | A | * | 1/1993 | Allan | 24/442 |
| 5,212,853 | A | | 5/1993 | Kaneko | |
| 5,242,646 | A | | 9/1993 | Torigoe et al. | |
| 5,345,659 | A | * | 9/1994 | Allan | 24/442 |
| 5,382,462 | A | * | 1/1995 | Pacione | 428/95 |
| 5,555,608 | A | * | 9/1996 | Allan | 24/442 |
| 5,586,372 | A | * | 12/1996 | Eguchi et al. | 24/452 |
| 5,596,794 | A | * | 1/1997 | Shibanushi | 24/452 |
| 5,598,610 | A | * | 2/1997 | Torigoe et al. | 24/444 |
| 5,640,744 | A | | 6/1997 | Allan | |
| 5,655,268 | A | * | 8/1997 | Keyaki et al. | 24/114.9 |
| 5,671,512 | A | * | 9/1997 | Hattori et al. | 24/452 |
| 5,797,170 | A | * | 8/1998 | Akeno | 24/452 |
| 5,891,549 | A | * | 4/1999 | Beretta et al. | 428/100 |
| 5,943,705 | A | * | 8/1999 | Sink | 2/338 |
| 5,953,797 | A | | 9/1999 | Provost et al. | |
| 5,983,467 | A | | 11/1999 | Duffy | |
| 6,054,091 | A | | 4/2000 | Miller et al. | |
| 6,132,660 | A | | 10/2000 | Kampfer | |
| 6,248,276 | B1 | | 6/2001 | Parellada et al. | |

* cited by examiner

*Primary Examiner*—James R. Brittain
(74) *Attorney, Agent, or Firm*—Pro Se

(57) ABSTRACT

Improved Fasteners of the Slidingly Engagable type are provided in uni-directional and multi-directional orientations, in single and double-sided configurations, and in a range of designs which also include provisions for attaching certain embodiments of such fasteners to a substrate material. A method of economically producing such fasteners and products incorporating such fasteners in diverse materials is also disclosed.

45 Claims, 16 Drawing Sheets

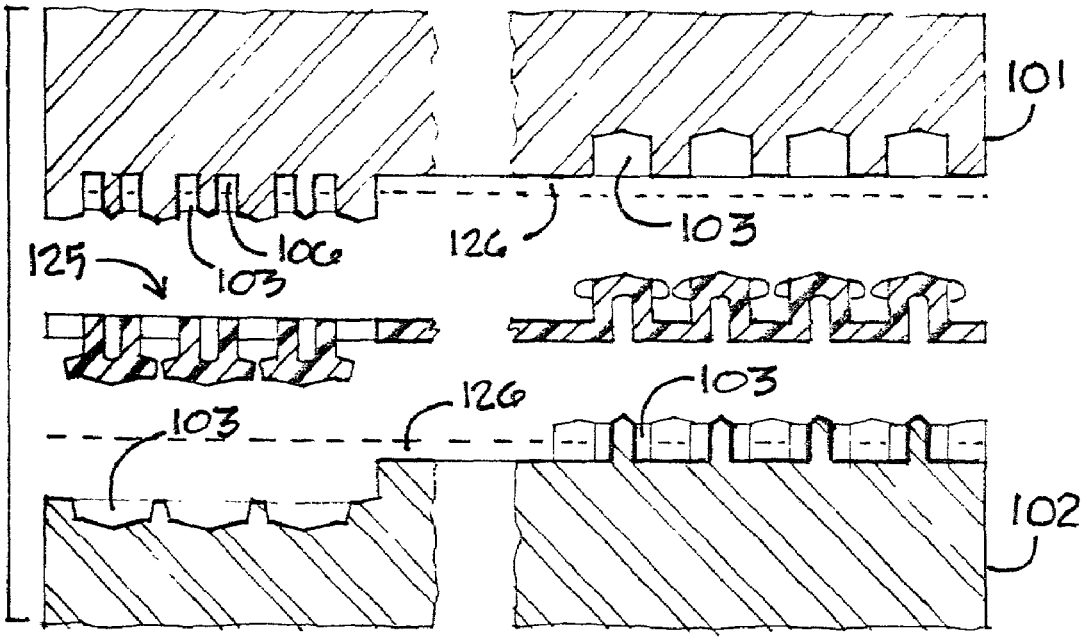
Fig.13
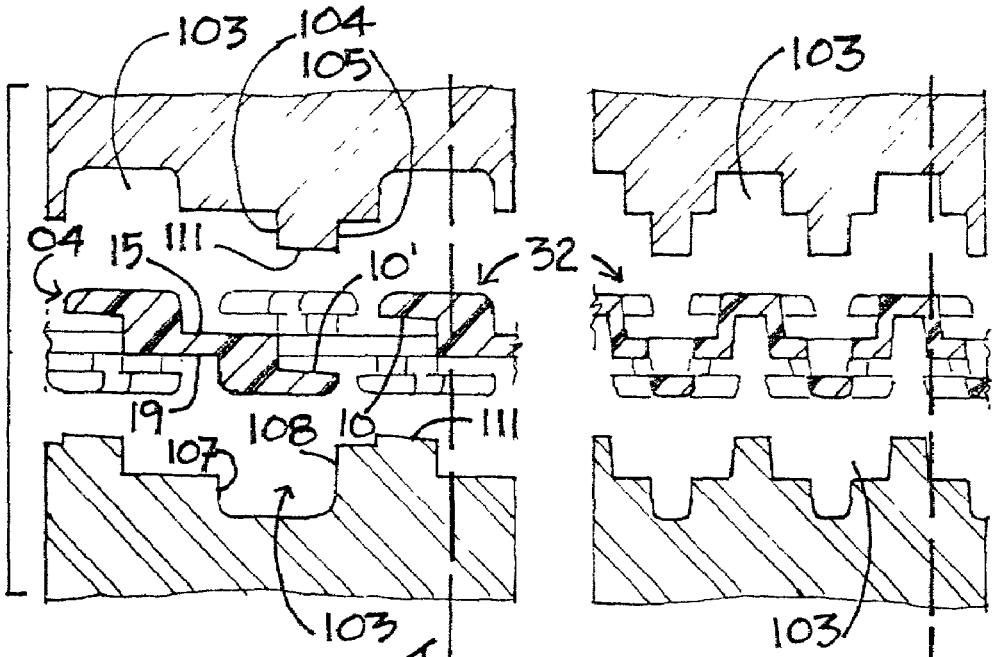
Fig.14
Fig.14A

SLIDINGLY ENGAGABLE FASTENERS AND METHOD

FIELD OF INVENTION

This application claims the benefit of U.S. Provisional Applications No. 60/288,780 filed May 5, 2001 and No. 60/241,707 filed Oct. 19, 2000 in regard to Priority status as provided under 35 USC 119 (e)(1).

BACKGROUND

Surface Fasteners of the Slidingly Engagable type (SEFs) were disclosed in U.S. Pat. No. 5,983,467 entitled "Interlocking Device" by the undersigned. That disclosure included a range of fastener types, each including portions with a base structure having pluralities of apertures and islands, which may be slidingly engaged by application of a relative shearing force, so that the individual islands of one portion become interlocked within complementary apertures of the other, and vice versa. SEFs may be provided in various designs including uni-directional or multi-directional orientations; may be hermaphroditic or have different male and female portions; may be configured to connect a point, an edge, a strap, a surface or other condition; may include an associated aperture opening that provides a "snap fit" prior to engagement, and may also include diverse self-alignment and coupling mechanisms.

Typically, the individual apertures of Slidingly Engagable Fasteners are designed to receive complementary islands so as to allow a relatively loose and imprecise initial alignment to result in a relatively tight and more precise engaged state, after application of a relative shearing force. Three characteristics define this aspect. First, the apertures and complementary islands are effectively tapered in at least one dimension in relation to the axis of engagement so as to provide an aperture opening that is somewhat larger in at least one dimension than the leading edge of an associated island, thereby abetting self-alignment of the elements. Secondly, each such aperture includes at least one undercut wall segment which, after application of the relative shearing force (i.e. a force applied to one of the portions in a direction generally parallel with the basal surface) to the aligned portions, engages a complementary island undercut sidewall segment so as to contain the island and prevent further movement in a direction generally perpendicular to the basal surface (vertical). Thirdly, each such aperture also includes wall segments which, upon application of the relative shearing force, engage complementary island sidewall segments so as to contain such island and prevent further movement in the direction of such applied shearing force (engagement direction) or in a direction generally perpendicular to such force and also parallel with the basal surface (lateral direction). The term "slidingly engaged" is intended to convey that the islands are caused (by the relative shearing force) to enter complementary apertures so that the island sidewalls progressively approach aperture walls until reaching a state of full contact and engagement, in which state the portions are effectively interlocked.

The profile shape of such walls and sidewalls (as viewed in cross section perpendicular to the axis of engagement), as illustrated in U.S. Pat. No. 5,983,467 include orthogonal dovetail-like shapes, ogee-like shapes, and variations of such shapes. It is apparent that any profile shape which provides the appropriate engagement and containment aspects as described above may be used. It may also be understood that any such walls or sidewalls need not be contiguous in order to provide such engagement and containment aspects. Therefore it has become known to the present inventor that Slidingly Engagable Fasteners may include elements which are discontinuous, perforated, or otherwise modified in design, provided only that the essential function and structural integrity of the device is maintained. In that a basic engineering design precept entails minimizing resources in order to achieve a particular function, it may therefore be desirable to produce Improved SEFs with such discontinuity, perforations or other modifications in order to minimize such resources. SEFs can provide significant advantages over hook-and-loop, mushroom-type and other surface fasteners, as well as a wide variety of mechanical fastening devices, for many applications. Such advantages include superior shear and tensile strength, low profile, ease of use, durability, a non-grabbing texture, and numerous other aspects. However, in order to advantageously provide these advantages, a simple and economical method of producing SEF fasteners in large or small quantities, in a variety of materials, and in a range of designs is needed.

In addition to the need for an improved method of production, a number of potential improvements to such fasteners are also desirable which may also be related to such method of production. Slidingly Engagable Fasteners should be available in a variety of materials including molded thermoplastics, other moldable materials, paper and paper board, composite and fibrous materials, and in formed metals, plastics and other malleable materials. Flexibility of the overall structure should be combined with structural integrity of individual fastening elements. SEF products should be available in a range of scales for a diversity of applications. Use and disposition of materials should be economical. Low profile and high strength aspects should be maximized. Fastener portions for many potential application environments should be self-cleaning. Self connecting fasteners in strap or linear forms should be available, including double-sided fastener straps and surfaces. Provisions for integrally attaching SEFs to various substrates should be available. SEF portions which may be integrally molded or formed as part of a larger component or product are also needed. Fasteners which combine certain of these aspects as well as other features are also needed.

Working prototypes of SEFs in various embodiments have been produced by molding, machining, forming, constructing, and die cutting diverse materials such as hard and soft plastics, wood, paper and paperboard, foam, sheet metal, ceramic materials, and composite materials. Although these models have generally been functionally successful, the need for a simple and inexpensive method of production is apparent. Molding or forming SEF fastener portions by conventional methods is complicated by the fact that such fasteners include a multiplicity of undercut surfaces. Although conventional molding or forming techniques may be employed to produce various uni-directional SEFs, multi-directional embodiments present a particular challenge. Therefore, a relatively simple method is needed which will provide for the removal of that part of the die or mold which defines the underside of such undercut surfaces without harming, weakening, or comprising the design of the product.

Several known manufacturing processes are applicable to the present invention: injection molding utilizing a reciprocating machine; continuous molding in which a substance is molded between a set of counter rotating rollers, effectively extruding a continuous product; die forming utilizing a reciprocating press; and continuous die forming in which a sheet of material is formed between a set of rotating dies. Each of these processes has been developed extensively over many years, and are not claimed herein except in relation to the present invention. Each such process also involves numerous secondary systems for pressurizing, heating, cooling, lubricating, ejecting product and waste, and other considerations which are beyond the scope of this disclosure. The common aspects of these processes are that each utilize a set of dies or, more commonly, a single die with a corresponding anvil or backing, and an apparatus designed to provide pressure on a raw material in order to produce a product of the desired shape.

Reclosable surface fasteners such as molded hook-and-loop hookstrips and mushroom type fasteners, which also include undercut surface segments, are typically manufactured of molded thermoplastics. Erb U.S. Pat. No. 3,147,528 describes a method of producing hookstrips by reciprocal injection molding. Other methods utilize a continuous web process using a belt or rotary mold. Undercut fastening elements may be formed by a complex mold with internally moving elements i.e. Menzin et al U.S. Pat. No. 3,758,657; they may be directly molded in cavities provided in such a mold and rapidly cooled before forcibly (resiliently) stripping form the mold i.e. Fischer U.S. Pat. No. 4,775,310; or they may be formed in a two step process in which a base with an array of stems is first molded and the stems are subsequently reformed into hooks or mushroom shapes, i.e. Provost et al U.S. Pat. No. 5,953,797. Yet another possible manufacturing method includes a sacrificial mold portion for forming undercuts, i.e. Torigoe et al U.S. Pat. No. 5,242,649. Recently, Kampfer et al U.S. Pat. No. 6,000,160, Miller U.S. Pat. No. 6,054,091, and Parellada et al U.S. Pat. No. 6,248,276, each disclose improved methods of forming fastener elements by the aforementioned two step process. Many other examples provide variations and refinements to similar processes. It appears that the quest for a definitive method of manufacturing fastener products is ongoing.

Utilizing a set of interengaging dies is a known method of manufacturing complex products with under-surfaces, most commonly known in paper and sheet metal stamping at least far back as Hodgson U.S. Pat. No. 299,982 of 1884, but also employed in plastic molding. Methods of producing certain designs of hook-and-loop hookstrips and mushroom type fasteners by utilizing an apparatus which includes a set of bypassing dies are also known. Kaneko U.S. Pat. No. 5,212,853 discloses injection molded surface fastener products that utilize a set of male and female interdigitating dies to form a unique mushroom-type fastener portion, although such method is not claimed. Kaneko's product includes a fastener head on two legs which are flush with the head perimeter, apparently to provide flexibility. His method includes a set of male and female dies with abutment faces, such faces being more or less perpendicular to the product surface structure. Although it is noted that the abutment faces are slightly tapered to facilitate die separation, it would appear that, without further remedy, repetitive use under heat and pressure could cause die seizure or differential movement if anything other than small portions are produced. Like other types of mushroom fasteners, Kaneko's device appears to be limited in potential strength as related to durability under repetitive use. Kayaki U.S. Pat. No. 5,067,210 appears to depend on a similar molding method which is not described. His device appears to require relatively exact positioning in two dimensions, first to align the ribs then to align alternately offset elements. It is apparent that each such fastener has limited application.

Certain other known fasteners also include a fenestrated base structure which could be produced by a method incorporating bypassing dies. Spier, U.S. Pat. No. 4,581,792, describes a press-together surface fastener comprising a plurality of perpendicular tapered projections and complementary receptacles arrayed in alternating rows each surrounded by a contiguous base structure having openings at each such projection and receptacle. Spier's device, however, appears to maintain engagement by friction rather than providing any type of interlock. It requires precise alignment of the portions, and does not appear to provide significant resistance to shear. Cousins, U.S. Pat. No. 4,183,121, and Allan, U.S. Pat. No. 5,640,744, each disclose types of surface fasteners with undercut elements which include portions having a fenestrated base structure, an engagement mechanism which may be effected by a relative shearing force, and in which openings in the fenestrated base structure at least partially align with undersurface segments of individual engagement members. However, each of these fastening devices appear to require considerable precision in aligning the elements both lineally in columns and in angular orientation. The former, Cousins, appears to require consistent pressure along the length of its axis in order to engage all elements simultaneously, and does not provide for excess overlap when adjusted. The latter, Allan, also requires longitudinal alignment ribs to prevent lateral disengagement. Both provide fastening mechanisms which are not adaptable to resist shear forces oriented in more than a single radial direction and have other limitations.

A new manufacturing method for SEFs should include certain desirable aspects. For instance, having a positive means of defining the thickness of a fastener portion throughout its area is particularly important for producing wide products with either reciprocating or rotating molding systems. Provisions for maximizing production speed are also desirable. Providing enhanced surface features for functional, aesthetic, or identification purposes is also desirable. Precise definition of the shape of individual fastening elements is important in controlling the design of strength and release characteristics. Material efficiency, weight, and flexibility should be carefully designed. Strength of individual fastening elements and profile depth require precise control. Speed, simplicity, and economy of production are important considerations as well are tooling costs. Provision of a method by which fastener portions may be readily manufactured in a one-step process as part of a larger primary product would also have significant utility. In summary, there is a need for a simple, efficient, economical, precise, and versatile method of manufacturing Slidingly Engagable Fastening products.

SUMMARY OF THE INVENTION

Figure 1:
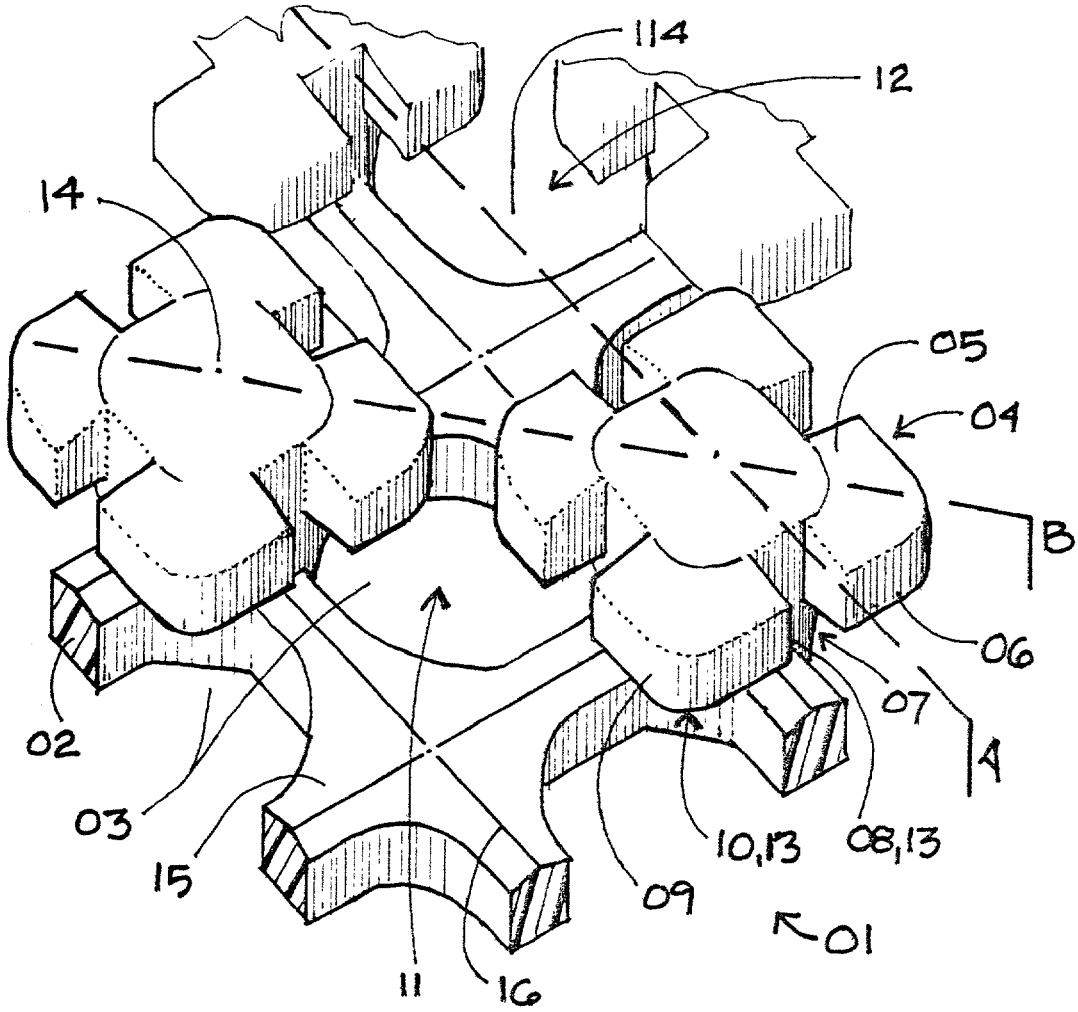
FIG. 1 Perspective view of a portion of an improved fastener of the Slidingly Engagable type (SEF) having multi-directional orientation and a quadrille configuration.

A first object of this invention is to provide Improved Slidingly Engagable Fasteners which can be produced inexpensively in large volume. A second object is to provide a method of economically producing such SEFs of diverse moldable or malleable materials. A further object is to provide such fasteners which are efficient in material usage. A further object is to provide such fasteners which are strong and flexible. A further object is to provide such fasteners in diverse configurations and designs. A further object is to provide such fasteners which include provisions for attachment to a substrate. A further object is to provide such fasteners which have two active sides. A further object is to provide such fasteners which include provision for extracting extraneous matter as they are engaged. A further object is to provide a method of manufacturing any such fasteners as an integral part of a larger manufactured product or product component.

The Improved SEFs disclosed herein include complementary portions each comprising: 1) a fenestrated common base structure having a plurality of fenestrations; 2) a plurality of islands each having at least one stem segment with walls, one or more undercut segments with undersides, and a top with an edge; and 3) a plurality of apertures defined by parts of island walls and parts of undersides of island undercut segments. At least a portion of the fenestrations in the common base structure are correspondent, in a direction generally perpendicular to the plane of the base structure, with corresponding undersides of the islands, and the solid segments of such base structure are generally contiguous with the stem portions of such islands. Each embodiment is designed to be slidingly engagable with a complementary portion upon application of a relative shearing force. The fenestrated base structure may also include larger fenestrations as well as other openings or surface features designed for functional or aesthetic effect.

Embodiments include examples of several types of Improved SEF: a multi-directional SEF arrayed in a quadrille pattern which aligns portions at 90 degree radial intervals and provides resistance to shear stresses of any orientation; a multi-directional portion arrayed in an alternating triangular pattern which aligns portions at 120 degree radial intervals and also provides multi directional shear resistance; a multi-directional portion arrayed in a hexagonal pattern which aligns portions at 60 degree radial intervals and provides multi-directional shear resistance; a uni-directional portion with islands and apertures arrayed in bilateral disposition; a double-sided embodiment which includes two active fastening faces on opposite sides of a common base structure thereby allowing the portion to be attached to separate complementary portions or to be doubled back and attached to itself at another location; a double-sided embodiment having a chevron configuration which provides uni-directional connection to portions on opposite sides; and an example of a product of which such improved fasteners are an integral part. Each of these embodiments are intended to schematically illustrate a range of design options and aspects which generally can be mixed or substituted within the scope of the invention. Embodiments include SEF portions which are molded and have differential profile thickness as well as other embodiments having a relatively consistent profile thickness which may be either molded or formed of a sheet material. Any of the embodiments illustrated can be molded or formed integrally with a primary product or component.

Mechanisms for attaching Improved SEF's to a substrate are also provided. These include: a backing portion having an array of pins designed to penetrate through a perforated substrate and engage with complementary receptors opening to the back side of an improved SEF portion; and an Improved SEF portion having an array of attachment devices projecting from its back side which are designed to penetrate and attach to a substrate. Improved SEFs may also be attached to a substrate by conventional means such as sewing or adhesives.

A method of manufacturing such fastener portions is also provided which incorporates an apparatus that includes a set of interengaging dies to effect a cavity which defines the shape of the resultant product. Each such die includes surface segments which are cavity walls, other surface segments which engage complementary segments of the corresponding die so as to define fenestrations in the resultant product, and associated aspects which are common to known molding or forming technology. The apparatus causes these dies to align and intermesh under sufficient pressure to cause a moldable or malleable material inserted therein to take the shape of the cavity as defined by the cavity walls. Because no portion of the dies are entrapped by any portion of the resultant product, the dies may be readily separated without stressing the undercut portion of fastener elements, and therefore the resultant product design is not limited by the difficulty of molding or forming such undercut portions, and the production process can be expedited.

This method differs distinctly from the common methods of manufacturing other types of surface fastener portions in that both the first and second dies include male and female elements and both may include surfaces which engage with corresponding surfaces of each other in interfacing positions which may be both perpendicular and normal to the common die axis, thereby defining fenestrations in the resultant product. Such fenestrations are aligned at least in part with the undersurfaces of undercut fastener islands thereby defining at least part of the walls of the apertures. The subject method also provides a mechanism for precisely controlling the thickness of molded fastener products in that the engaging surface segments of corresponding dies may be designed to define a specific cavity depth.

The associated apparatus may be of a type designed for molding a resinous or otherwise moldable substance, or the method may be used in conjunction with an apparatus designed as a cutting/bending press to form a malleable substance such as sheet metal or paper board. Such apparatus may be of a reciprocating type, such as an injection molding machine or reciprocating press, or it may be of a continuous production rotary type wherein the dies are arrayed along the surfaces of counter-rotating rollers or molding belts. Although the subject dies are typically to be designed for a specific product, material, and manufacturing technology related to the type of apparatus used, the common method is applicable to each such technology. Whichever apparatus is incorporated, it typically includes numerous basic elements commonly known to industry including means for: engaging the dies in their aligned position; applying pressure as necessary; inserting raw material; ejecting the finished product; and providing for heating, cooling, lubrication and other subsidiary parts of the process which are not claimed herein.

A significant improvement provided by the present invention is inclusion of the aforementioned fenestrated base structure. This aspect allows such Improved Fasteners to be manufactured economically of diverse materials by the method provided. The fenestrated base also provides for efficient utilization of material, enhances flexibility, provides a means for extracting foreign matter from the fastener assemblage, allows double-sided portions to be produced, allows a fastener portion to be molded or formed as part of a larger product, and provides other advantages which are apparent herein. The fenestrated base can also be designed to enhance the functions of diverting portions into self-alignment and coupling of the portions.

The Improved SEFs also provide significant other advantages including features that enhance usability for many applications. Very low profile, high strength fasteners may be produced because the effective engagement thickness may be as little as only two times the thickness of the material selected. A variety of designs can provide optional configurations and orientations, strength characteristics, functional, and aesthetic aspects. Fastener products can be reinforced or embellished by the inclusion of a reinforcing material. Flexible portions may be furnished in rolled form for shipment and installation. Double-sided SEF portions allow a greater range of application possibilities. Provision of self attachment mechanisms greatly increase the utility of SEF's for many applications and allow fastener portions to be subsequently attached to an end product by an original equipment manufacturer at another site. Provision of such a simple method of production allows fastener portions to be integrally molded or formed with a primary molded or formed product or assembly component, thereby providing such benefits as reduced assembly time and production cost, as well as improved integrated product designs.

Some of the significant advantages of producing fasteners by the method of this invention include the following: The production system is simple and economical and can be readily adopted to commonly known manufacturing systems. Molds of reciprocating or roller type may be produced by commonly known modern machining methods at lower cost than complex multipart molds. Material utilization can be optimized by designing the fenestrated product base in relation to the expected loading, and lower cost materials may be utilized where appropriate. A high degree of precision can be incorporated in the resultant product. Resultant fastener products can have a reasonable degree of flexibility due to the fenestrated base, even when manufactured of a fairly rigid material in order to maximize strength. Product design is not limited by mold release considerations. Because the product undersides may be precisely formed or molded, the strength and release characteristics of resultant fastener products may be designed precisely. Fastener products can be rapidly and economically produced in a large quantities, or fastener portions can be integrally manufactured as part of a larger molded or formed product.

DESCRIPTION

Figure 1A:
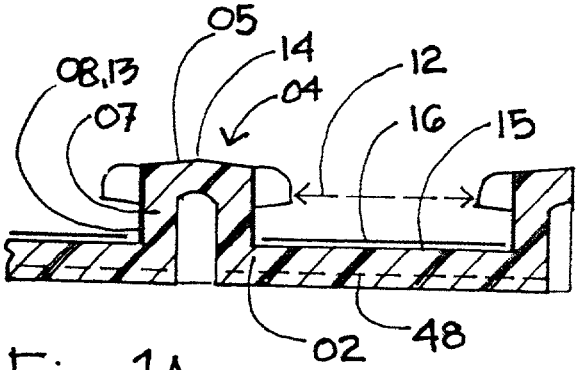
Figure 1B:
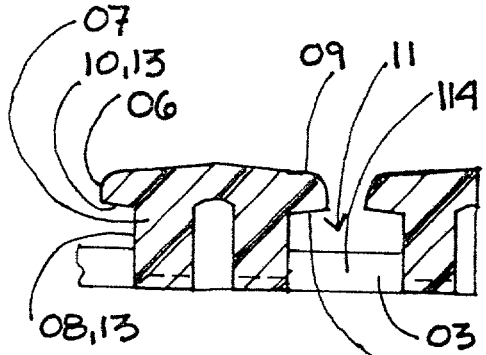

FIG. 1A schematically illustrates one portion of a first preferred embodiment 01, an Improved Slidingly Engagable Fastener of a quadrille design which includes two substantially identical such portions designed to fasten and interlock with each other upon application of a relative shearing force. Each such portion includes a base 02 with a first basal surface 15 and a plurality of undercut segments 09 which are spaced from the basal surface. At least the second such portion also includes a base 02 with a basal surface 15 having a plurality of fenestrations 03, and also includes a plurality of stems 07 each with a first end attached to the base and extending away from the base and attached to an undercut segment 09 which in turn extends away from the stem so as to effectively provide an undercut island 04 with at least one underside 10 spaced away from said basal surface. Such a configuration therefore provides at least one aperture 11 which is defined by the undersides 10 of two adjacent islands and the stems 07 which connect the islands with said base in such a spaced disposition. It can be seen that each such set of two adjacent islands are bilaterally disposed about an axis generally bisecting an intervening aperture; and the edges of such islands diverge from such axis so as to provide an aperture opening larger in at least one dimension than the leading edge of an associated island so as to present a generally tapered aspect in plane view. Therefore, a quadrille design of the type shown in FIG. 1 is arrayed along a longitudinal axis of anticipated shear which is generally diagonal to the nominally square shape defined by the island edges (diamond pattern in plane view) so as to effect such a tapered disposition for engagement. However it should also be understood that portions may be effectively connected, though not fully interlocked, when undersides are slidingly interfaced on an axis generally aligned with this generally square shaped (diagonal to the primary axis).

Each portion 01 may also include a plurality of said islands 04, each having a top surface 05 with an associated edge 06, a stem segment 07 with sidewalls 08, and undercut segments 09 with undersides 10, wherein said edge and said undersides are also sidewalls, and further wherein said undersides are aligned, in a direction generally perpendicular to the plane of said common base structure, with at least portions of individual said perforations. It should be noted that in this and other embodiments, said stems 07 are generally located between said undercut segments, and vice versa so as to effect an island having a top surface 05 with a segmented edge 06. In this instance, each such stem can be seen to be associated with four such undercut segment sin that they are contiguous with such segments. A plurality of apertures 11 may also be included in said portion 01, each said aperture having an associated aperture opening 12, and walls 13: wherein said aperture opening is defined by said associated edge 06 of each adjacent island 04, and wherein segments of said walls are coincident with segments of said sidewalls 08 and other segments of said walls are coincident with segments of said undersides 10. The portions are designed so that ones of said apertures receive ones of said islands so that, when two such portions are aligned (i.e. ones of islands are inserted through corresponding aperture openings) and are slidingly engaged by a relative shearing force, said first and second portions become connected and interlocked. Such interlocked portions may subsequently be disconnected by reversing said relative shearing force or, when the base of at least one portion is sufficiently flexible, the portions may be sequentially peeled apart.

Said first preferred embodiment 01 also, optionally, includes a plurality of conical protrusions 14 at the center of each said top surface of each said island, and as said fenestrated base has a first surface 15 between said perforations, said surface including in this design a complementary ridge 16, so that when the tops of the islands of two said portions are caused to contact by application of a perpendicular pressure, said conical protrusions divert the islands towards adjacent aperture openings 12. Therefore, an imprecise initial alignment of the portions results in alignment at the nearest 90 degree radial interval. Thereafter, as ones of said islands are inserted through said aperture openings 12 and caused to contact ones of said ridges 16 on said first face 15, continuing perpendicular pressure causes ones of said protrusions 14 to divert toward said perforations 03 in said common base structure 02, thereby initiating engagement of the portions by effecting a relative shearing force. This type of embodiment, having a quadrille design, allows fastener portions to be aligned and slidingly engaged at 90 degree radial intervals and thence provides resistance to shearing stresses in multiple directions in that, when subjected to a shear stress of a different direction, said islands tend to relocate and engage with whichever aperture is most closely aligned with such shear stress.

Embodiments of the type 01 illustrated in FIG. 1, wherein one stem is associated with three or more undersides, are designed to be manufactured of a moldable material utilizing a method incorporating a set of interengaging dies associated with an apparatus which is described below. Therefore, this type of embodiment may include a variable cross-sectional dimension, whereas other types of embodiments, as seen below, may have a relatively consistent cross-sectional dimension and therefore may be manufactured of either a moldable material or of a malleable material by utilizing such method with dies and apparatus of an appropriate design. Such molded embodiments may also include an optional integrally molded reinforcement 48.

Figure 2:
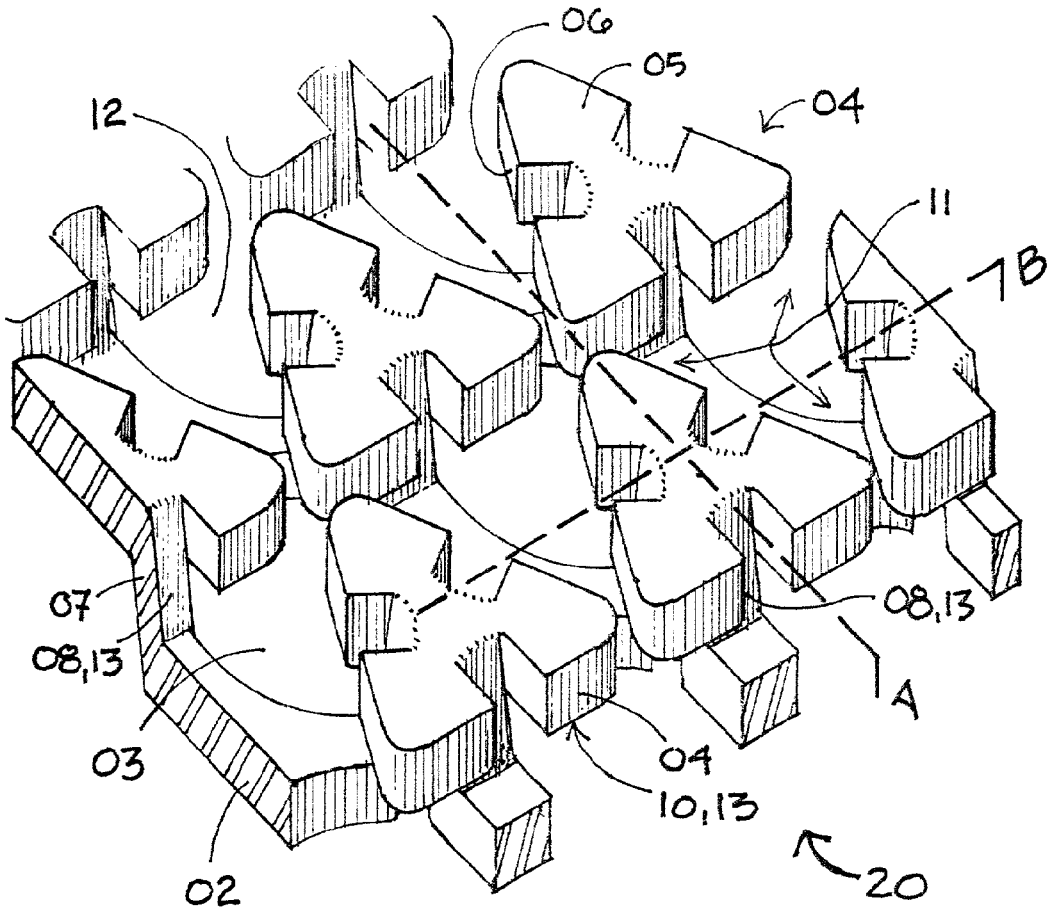
FIG. 2 Perspective view of an improved SEF portion having multi-directional orientation and a triangular configuration FIG. 3 Perspective view of an improved SEF portion having multi-directional orientation and a hexagonal configuration FIG. 4 Perspective view of an improved SEF portion having a uni-directional orientation and triangular configuration FIG. 5 Perspective view of an improved SEF portion having a uni-directional orientation and a stepped profile FIG. 6 Perspective view of improved SEF portions having a uni-directional orientation and chevron-like configuration, also having two fastening sides FIG. 7 Perspective view of an improved SEF portion with multi-directional orientation and triangular configuration, also having two fastening sides.
Figure 2A:
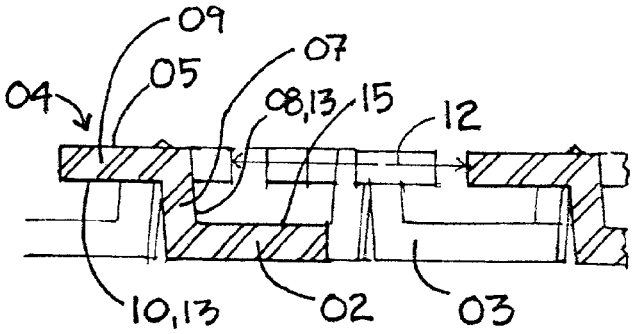
Figure 2B:
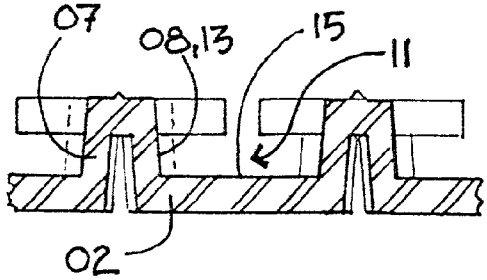

A second type of preferred embodiment 20, as illustrated in FIG. 2, also includes a fastener portion having a fenestrated common base structure 02 with a plurality of perforations 03; islands 04 each having a top surface 05 with an associated edge 06, undercut segments 09 with undersides 10, and a plurality of stem segments 07 with sidewalls 08; and a plurality of apertures 11 each having an associated aperture opening 12, and walls 13 which are coincident with segments of said sidewalls 08 and of said undersides 10 as in the embodiment described above, and is designed to slidingly engage with a similar portion when a relative shearing force is applied. This embodiment is configured so that said top surfaces of said islands and said aperture openings are of a generally triangular configuration arrayed in alternately offset rows, thereby allowing portions to be aligned and engaged at substantially 120 degree radial intervals. An advantage of such a triangulated design is that for many applications such as adjustable straps it provides a readily apparent visual key as to the intended directionality of engagement.

In this type of embodiment 20, each said island 04 has a plurality of said stems 07, each such stem associated with just two adjacent undercut segments, and said islands and said common base structure 02 have a generally consistent thickness, so that such a portion may be produced either by molding a moldable substance as in the previously described embodiment or by perforating and forming a malleable sheet material utilizing said method incorporating said interengaging dies and said apparatus.

Figure 3:
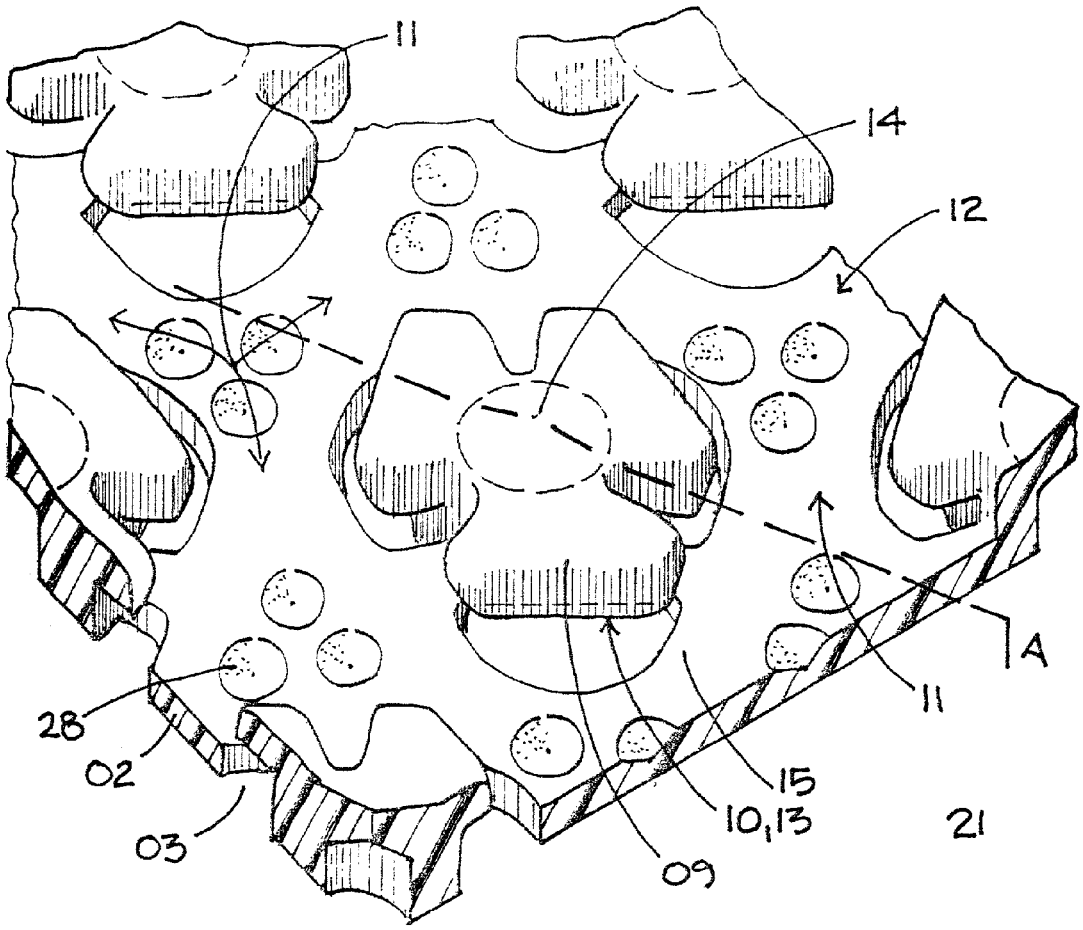
Figure 3A:
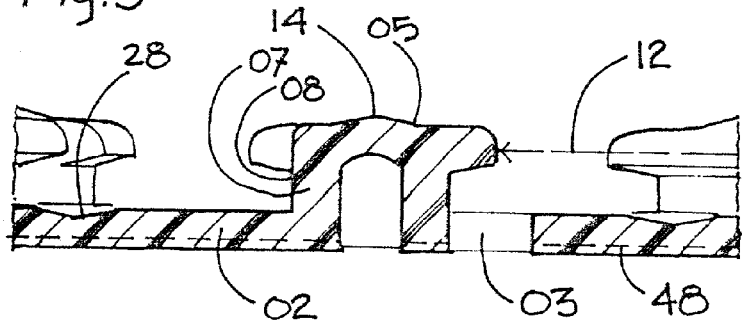

A third preferred embodiment 21, illustrated in FIG. 3, also includes a fenestrated base structure 02 with perforations 03, islands 04, complementary apertures 11 and other aspects as in the previous embodiments. This embodiment, however, is configured in a hexagonal design with islands having a generally hexagonal shape arrayed in offset rows and columns so as to define a multiplicity of apertures associated with each island at 60 degree radial intervals thereby allowing engagement of two portion of said an embodiment at such 60 degree radial intervals. Each island 04 therefore corresponds with six aperture openings 12 defined by adjacent sets of three such islands, whereas each of three undercut segments 09 is included between each of three stem segments 07 and each stem is associated with three undercut segments 03 so as to provide undercut segments extending beyond each of the six sides. It is apparent that multi-directional embodiments such as this could also include additional divisions of stem and undercut segments, for instance the present embodiment could alternatively include six stems and corresponding undercut segments, etc.

This embodiment 21 also includes island top surfaces having a conical protrusion 14 which is designed to help align and couple said portions. As in the previous embodiment 01, when two such portions are approximately aligned and subjected to compressive pressure, ones of said conical protrusions cause complementary sets of said islands to slide into alignment with said aperture openings so that continuing pressure causes ones of said islands to enter ones of said aperture openings. In this instance, however, the conical protrusions 14 may then be diverted into a corresponding cavity 28 on the basal surface by a relatively slight initial relative shearing force, thereby coupling said portions in an engaged state until an opposing relative shearing force is applied to reverse such engagement. An important aspect of such a hexagonal design combined with such conical protrusions is that two such fastener portions may be pressed together at virtually any radial disposition and will thence self-align at the nearest 60 degree disposition, so long as at least one portion is allowed to rotate up to 30 degrees. Therefore a press-together fastener is provided which may be connected from any initial angular disposition of the portions.

Figure 4:
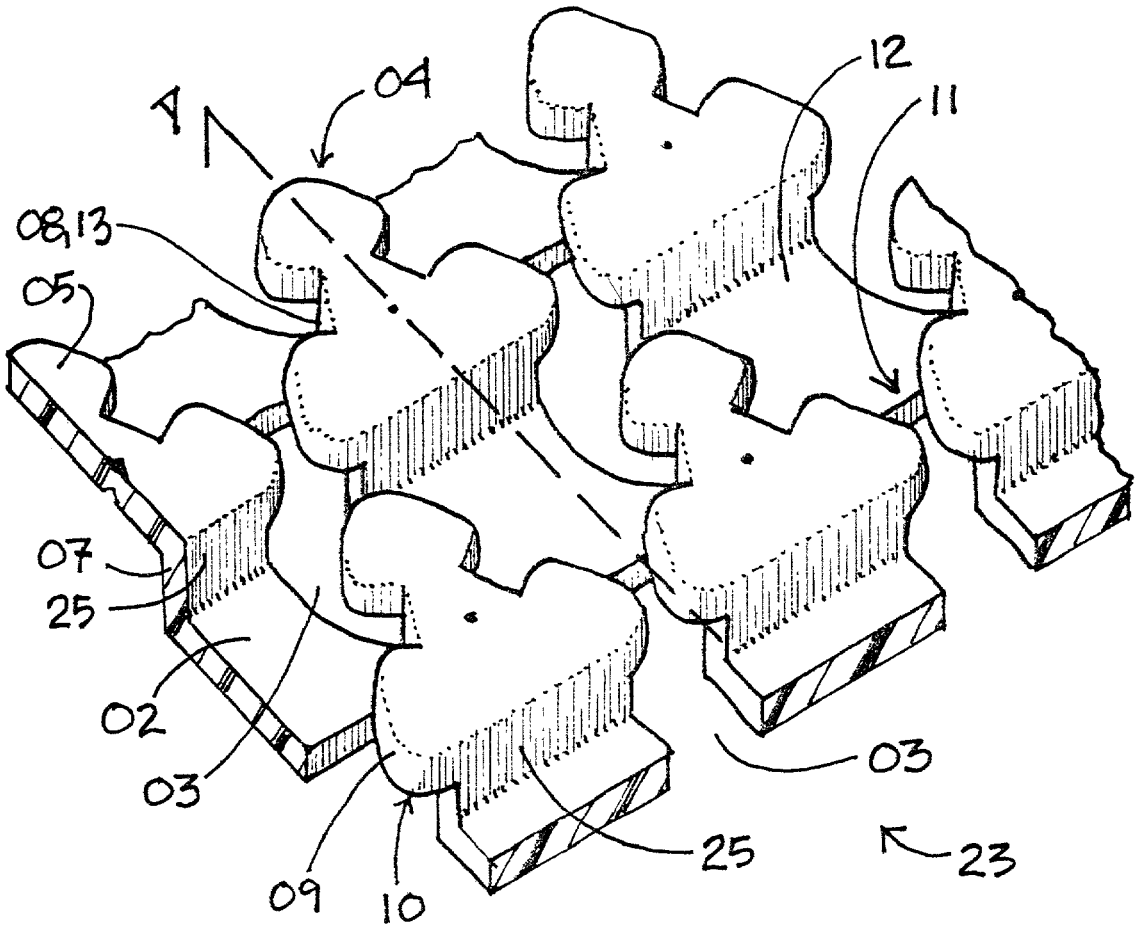
Figure 4A:
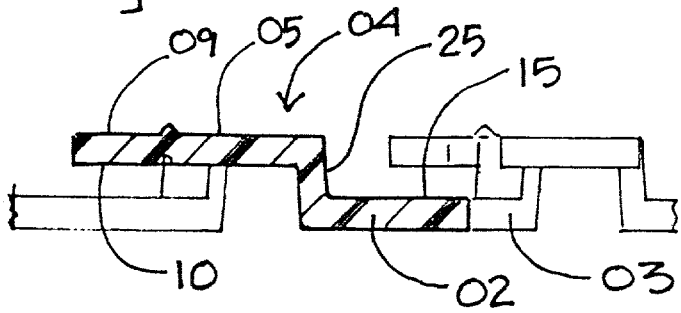
Figure 5:
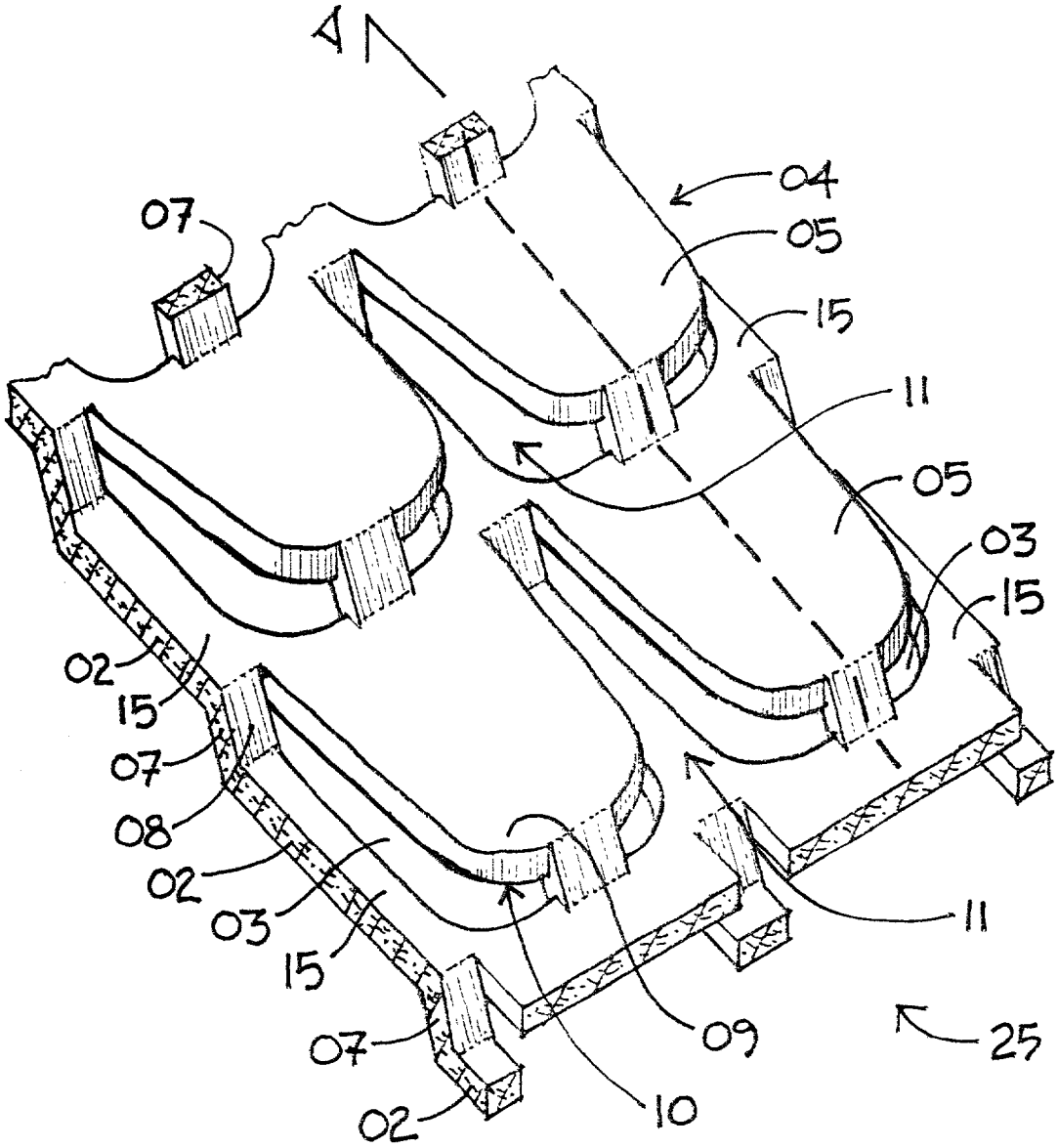
Figure 5A:
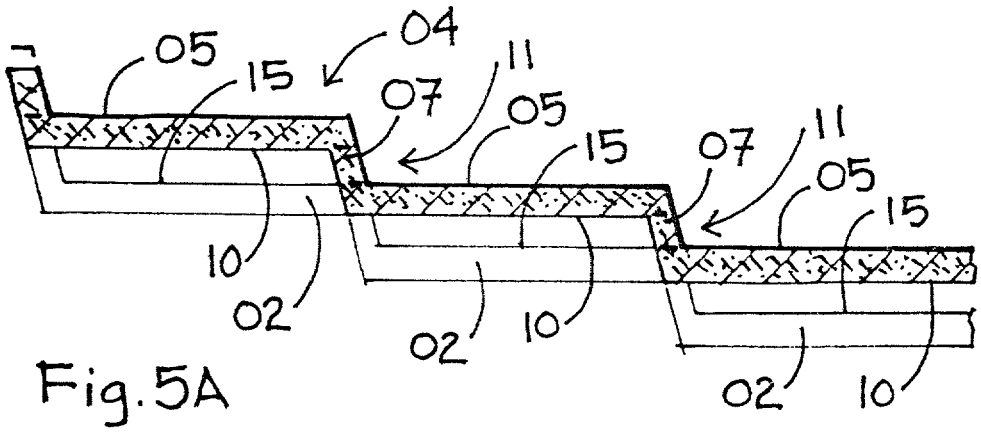
Figure 6:
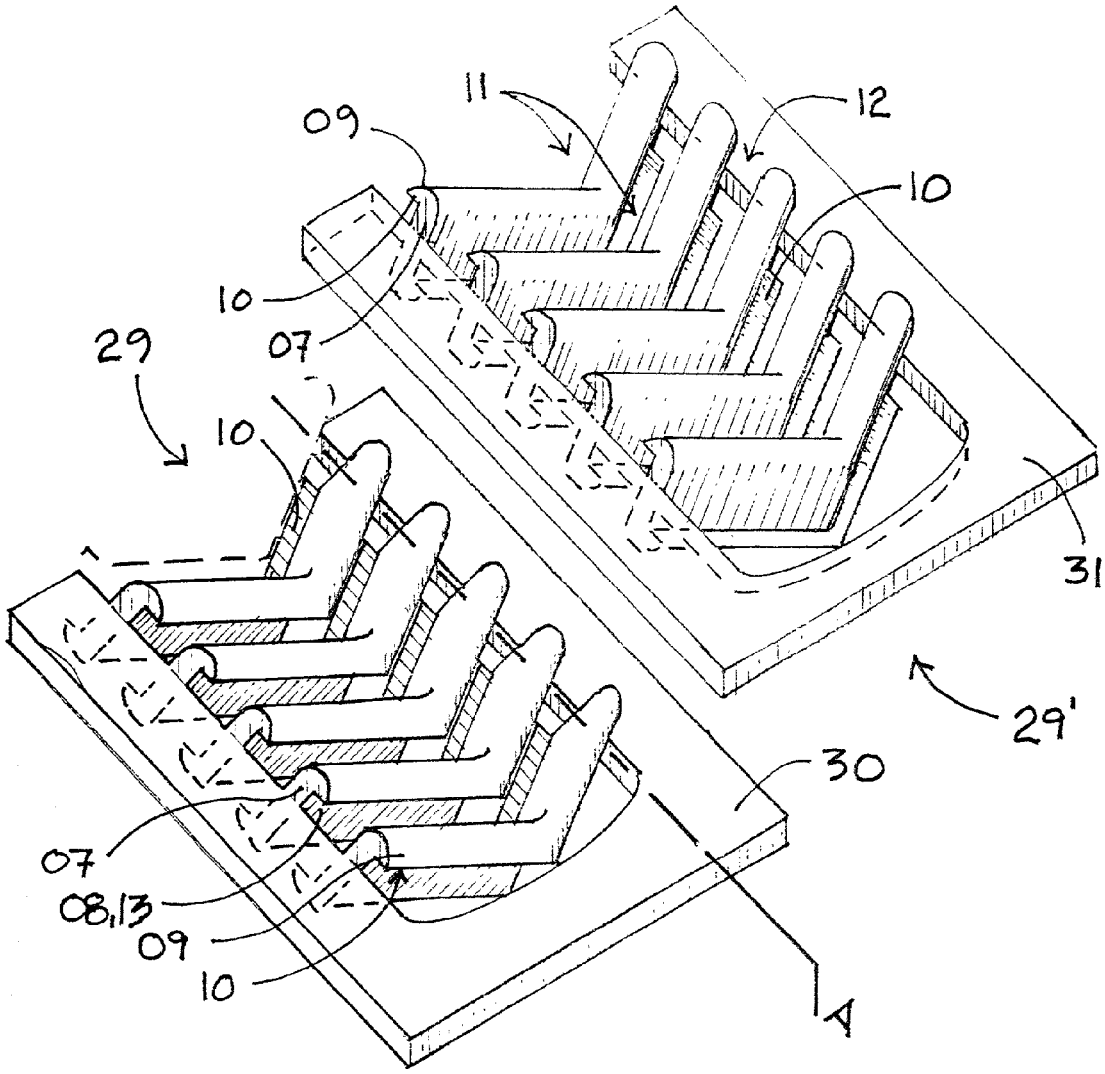
Figure 6A:
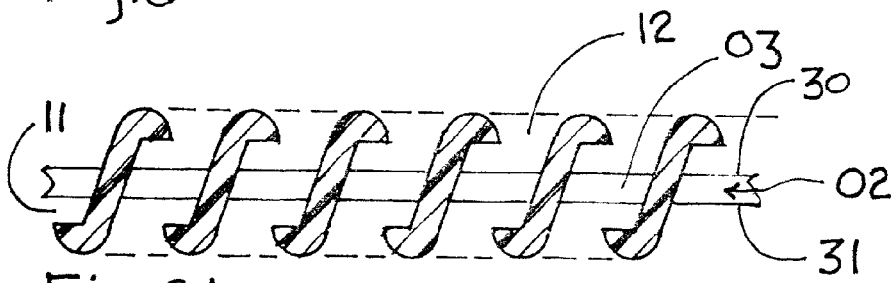

A fourth preferred embodiment, illustrated in FIG. 4, includes an improved slidingly engagable fastener portion 23 having a plurality of triangular islands arrayed in offset rows so as to provide a uni-directionally oriented, longitudinally adjustable fastener. As in the embodiments described above, each portion includes pluralities of islands 04 and complementary apertures 11 associated with a fenestrated common base structure 02. In this type of embodiment 23, each of said islands includes stem segments 07 with sidewalls 08 and also includes undercut segments 09 with undersides 10, said stem segments and undercut segments being bilaterally disposed so as to define one of said apertures 11 between each pair of adjacent islands designed to receive and engage one island in a directionally opposite orientation. (The term "bilaterally disposed", as used herein, is intended to define pairs of undersides ((associated with islands)) which are generally bilateral in plane view about a longitudinal axis of anticipated shear. It can be appreciated that adjacent pairs of undersides in each embodiment of the invention are thus "bilaterally disposed", but that in uni-directional embodiments such as in FIGS. 4, 5 and 6 islands can be said to be bilaterally disposed only, whereas in multi-directional embodiments such as in FIGS. 1, 2 and 3 sets of undersides ((islands)) may also be said to be disposed in other pluralities). One of each of said stem segments 07 of each said island 04 of this embodiment also provides a stopping wall 25 which is designed to prevent ones of said islands from inadvertently being removed from a pre-engaged disposition when an assembly of said portions is subjected to flexure or to a reversal of said relative shearing force, unless a perpendicular peeling force is also applied. Therefore said fastener portion 23 is designed to primarily resist shear stresses oriented in a single direction and will also resist inadvertent release when said shear stresses are reduced or absent, unless such a perpendicular peeling force is also applied. Such uni-directional fasteners may be designed to provide superior shear and tensile (vertical) strength for applications where only uni-directional stresses are expected, and also to provide relative ease of release by peeling.

A fifth preferred embodiment 25, illustrated in FIG. 5, includes a plurality of bilaterally disposed islands 04 configured in a uni-directional orientation in which said islands are contiguous with a common fenestrated base structure 02, said fenestrated base structure being stepped in profile at each alternate row of said islands so as to provide apertures between such islands. Said islands and apertures are arrayed in rows so that a first surface 15 of said common base structure 02 in a first row is substantially coplanar with the top surface of said island tops 05 of a subsequent adjacent second row, and a second surface 19 of said fenestrated common base structure 02 in such a first row is coplanar with ones of said undersides 10 of said islands of said subsequent adjacent row; whereas said first and second surfaces are not coplanar with corresponding islands and apertures of a third adjacent row but are rather spaced from them by a distance equal to one of the aforementioned steps. Said stems 07 connecting said base structure 02 with said islands 05 thereby effect the aforementioned stepped profile and provide structural continuity to the whole, each stem being associated with two laterally adjacent undersides (except at outer edges of the portion). Therefore, a first said fastener portion 25 can be attached to a like portion 25 in opposed disposition, or it can be attached to a further portion of itself when doubled or folded into such a position. It is noted that the term "coplanar" as utilized herein is intended as a relative term not intended to preclude twisting or flexing of the whole or any element thereof. A significant aspect of this type of embodiment is that it can be readily produced of virtually any malleable sheet material by the method herein described using a set of cutting/bending dies in a relatively simple apparatus. Such materials may include sheet metal, paper, cardboard, composite materials, thermoformable plastics, or other sheet materials. Another significant aspect is that this embodiment provides a very low-profile, thus a fully engaged fastener may be only twice the thickness of its base structure. Therefore a wide range of versatile, low-cost, self-aligning, self-attaching, low-profile fastening products is provided which may be utilized for packaging sanitary disposable products and other applications.

A sixth preferred embodiment 29, which is illustrated as the end segments of a strap, is shown in FIG. 6. Said embodiment 29 includes a plurality of islands 04 and a plurality of complementary apertures 11 each configured in a chevron configuration on both the first 30 and second 31 sides of common fenestrated base structure 02. Said islands on said first side 30 being configured in a first directional orientation, and said islands on said second side 31 being configured in a second directional orientation; so that the walls 13 of a plurality of said apertures 11 of complementary orientation are defined by said sidewalls 08 of said stem segments 07 and by said undersides 10 of said undercut segments 09 in each of two complementary directional orientations. Therefore, said islands of said first side 30 of said portion 29 may be slidingly engaged with apertures of said second side 31 of a similar portion and vice versa, thereby providing a double-sided self-connecting linear fastener.

Figure 7:
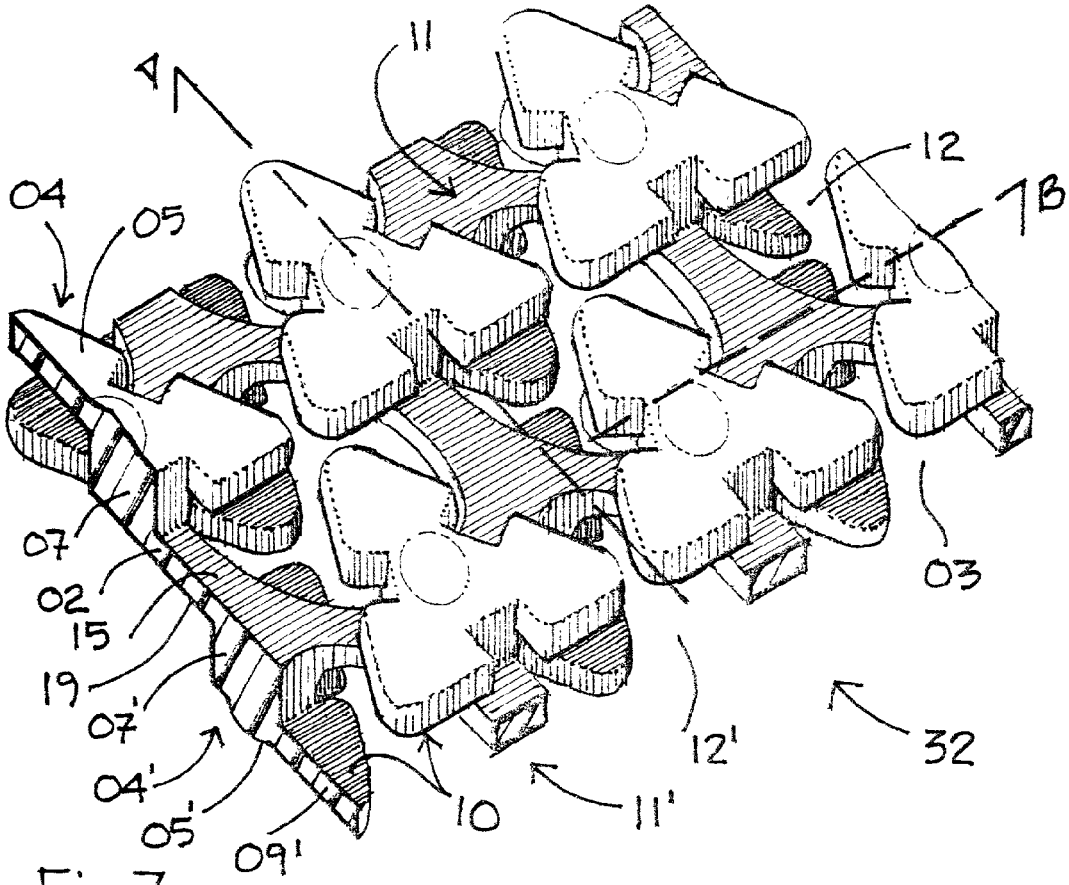
Figure 7A:
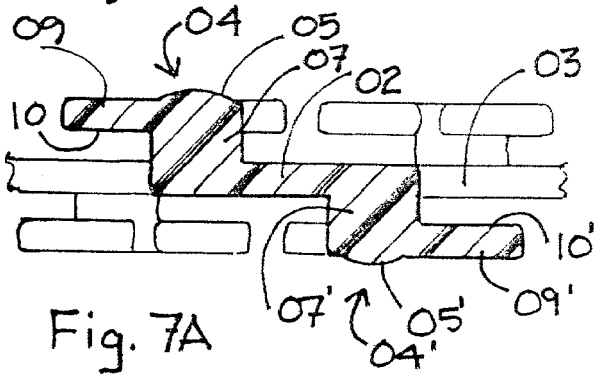
Figure 7B:
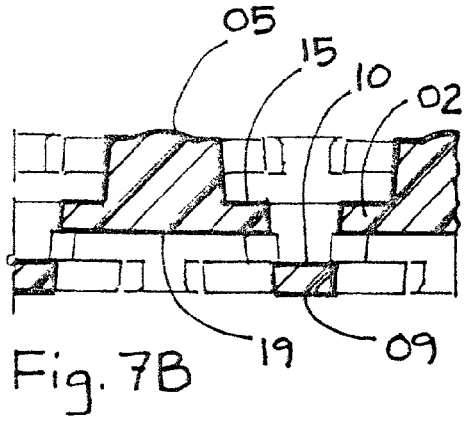

FIG. 7 illustrates a fastener portion 32 with multi-directional orientation having two opposite engageable sides of similar design. Each such engageable side in this example includes an array of alternately offset islands and apertures of a triangular design similar to that shown in FIG. 2 above. In this embodiment however, said fenestrated common base 02 is contiguous with said stem segments 07 of islands 04 on both said base structure's first 15 and second 19 faces. Said associated aperture openings 12 are accessible to corresponding islands inserted into either surface at 60 degree radial intervals, and may be engaged at such radial intervals. Therefore, embodiments of said type 32, when attached to a like portion (or to a single-sided portion of like design as in FIG. 2) on either surface, provide multi-directional resistance to shear stresses. It is readily apparent that such double-sided, multi-directional fasteners may also incorporate other designs such as the quadrille and hexagonal configurations shown in FIGS. 1 and 3.

Figure 8:
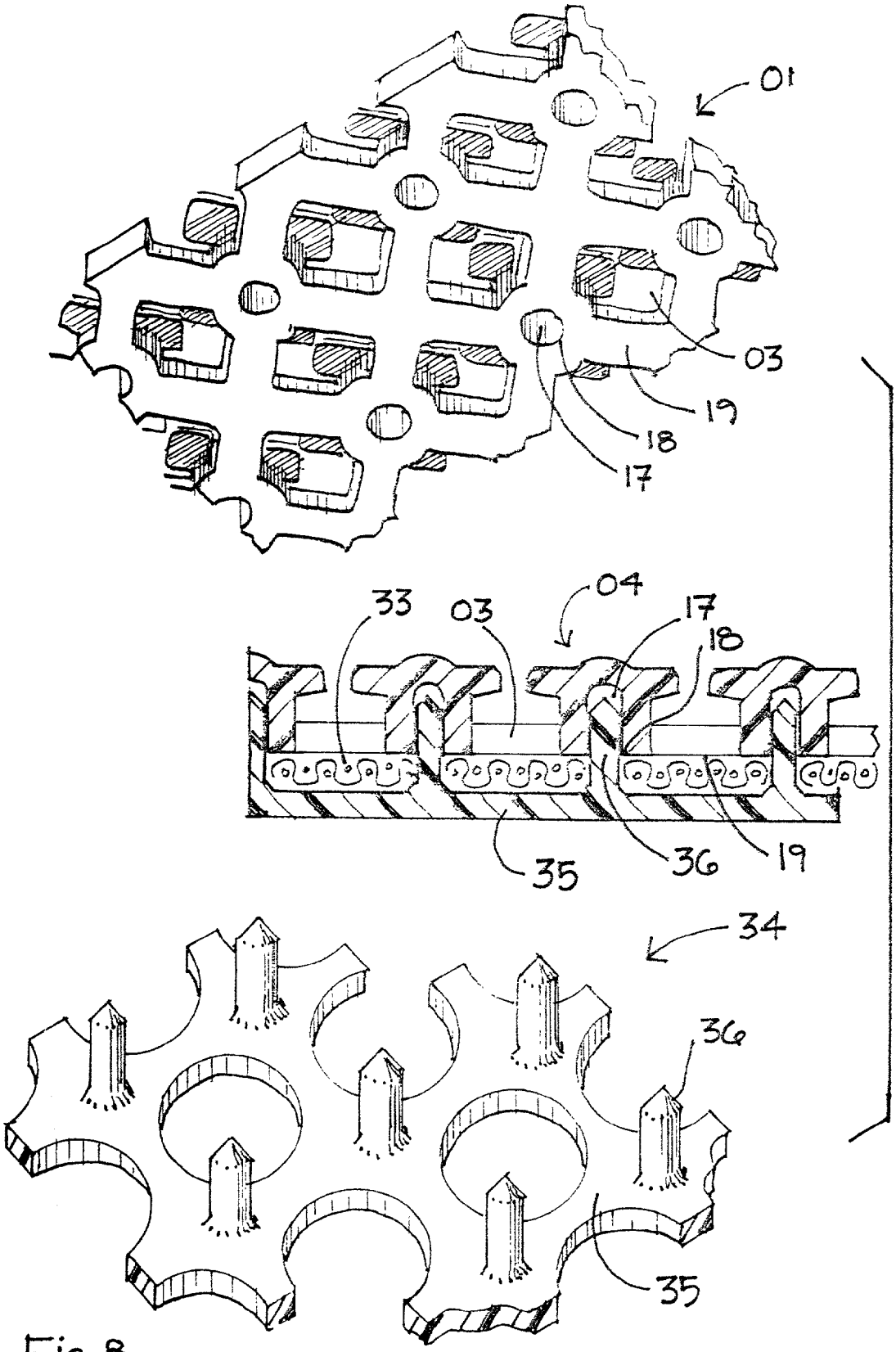
FIG. 8 Expanded perspective view showing the underside of an embodiment with a provision for attachment to a substrate, including sectional view of completed assembly FIG. 9 Sectional view of an embodiment with an alternative provision for attachment FIG. 10 Perspective view of a product incorporating SEF portions as an integral part.

FIG. 8 illustrates a molded fastener portion, such as that of embodiment type 01 illustrated in FIG. 1, along with a backing portion 34 designed to attach said portion to a substrate material 33 such as fabric. Said fastener portion 01 includes a plurality of receptors 17, each such receptor located at the center of each said stem segment 07 and having an associated receptor entrance 18 located on said second surface 19 of said fenestrated common base structure 02. Backing portion 34 includes a contiguous backing structure 35 having a plurality of attaching pins 36 extending therefrom. Said attaching pins are arrayed in a pattern compatible with said receptors of said fastener portion so that said attaching pins may be inserted through perforations 37 in said substrate material and received through said receptor entrances 18 into said receptors 17, thereby attaching said fastener portion to said substrate. Said attaching pins may be permanently retained in said receptors by friction, or may be held by an adhesive, rf welding or other such known technology.

Said backing structure 35 may be designed to provide sufficient flexibility so as to allow the entire assembly to be flexed if desirable for a particular application. Such flexibility may be useful in many applications such as in apparel. Alternatively, said backing structure 35 may be designed to enhance the rigidity of the complete assembly, thereby reinforcing said fastener portion, or a segment of same at its point of attachment, as in an application where a flexible fastening strap is to be connected to a rigid base. Corresponding to such requirements for flexibility or rigidity, said backing structure 35 may include fenestrations as illustrated to enhance flexibility or may be solid and contiguous in order to enhance rigidity.

Figure 9:
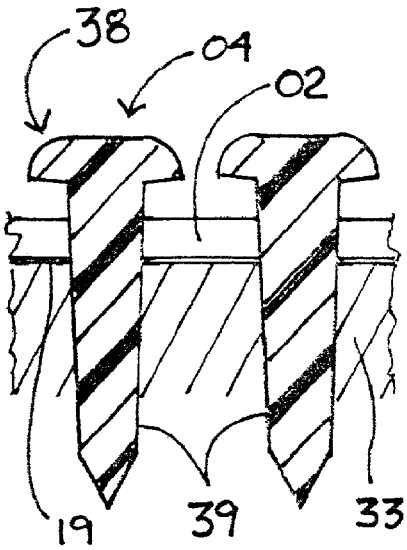
Figure 9A:
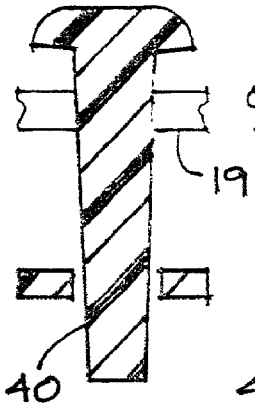
Figure 9B:
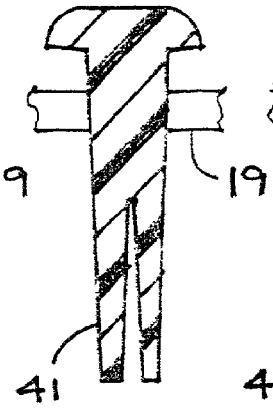
Figure 9C:
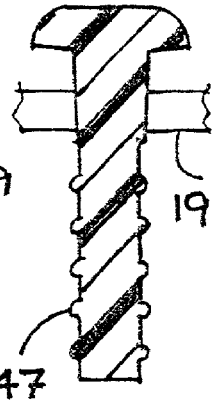
Figure 9D:
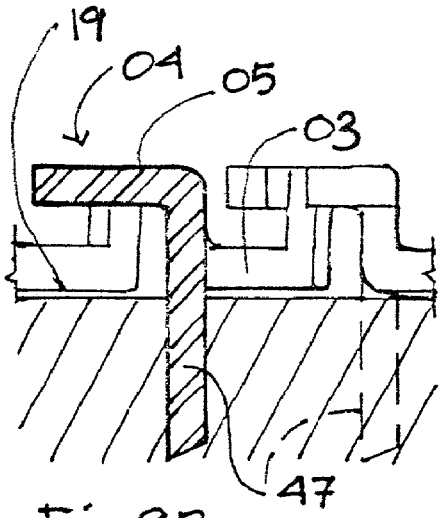
Figure 9E:
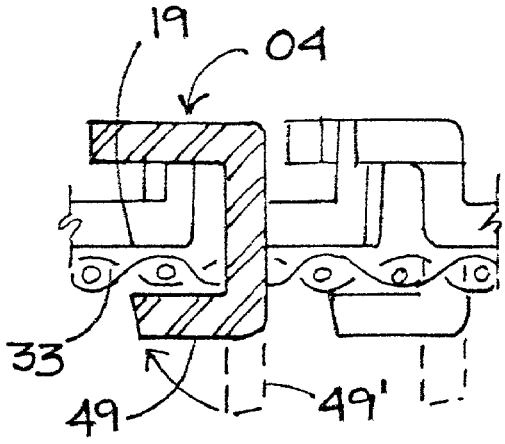

FIG. 9 illustrates an alternative mechanism for attaching a fastener portion 38 to a substrate, wherein said fastener portion is designed to include a plurality of attachment devices 39 extending from said second surface 19 of said base structure. Said attachment devices may be designed in the form of nails 39 as in FIG. 9, rivets 40 as in FIG. 9A, expansion devices 41 as in FIG. 9B, friction fitting devices 47 as seen in FIGS. 9C and 9D, Folding devices 49 as in FIG. 9E, or other device appropriate for attachment to a particular substrate type. Such an attachment device of an appropriate design for a particular substrate may then be attached to same by an appropriate mechanical means such as hammering, peening, expanding, driving, etc.

Figure 10:
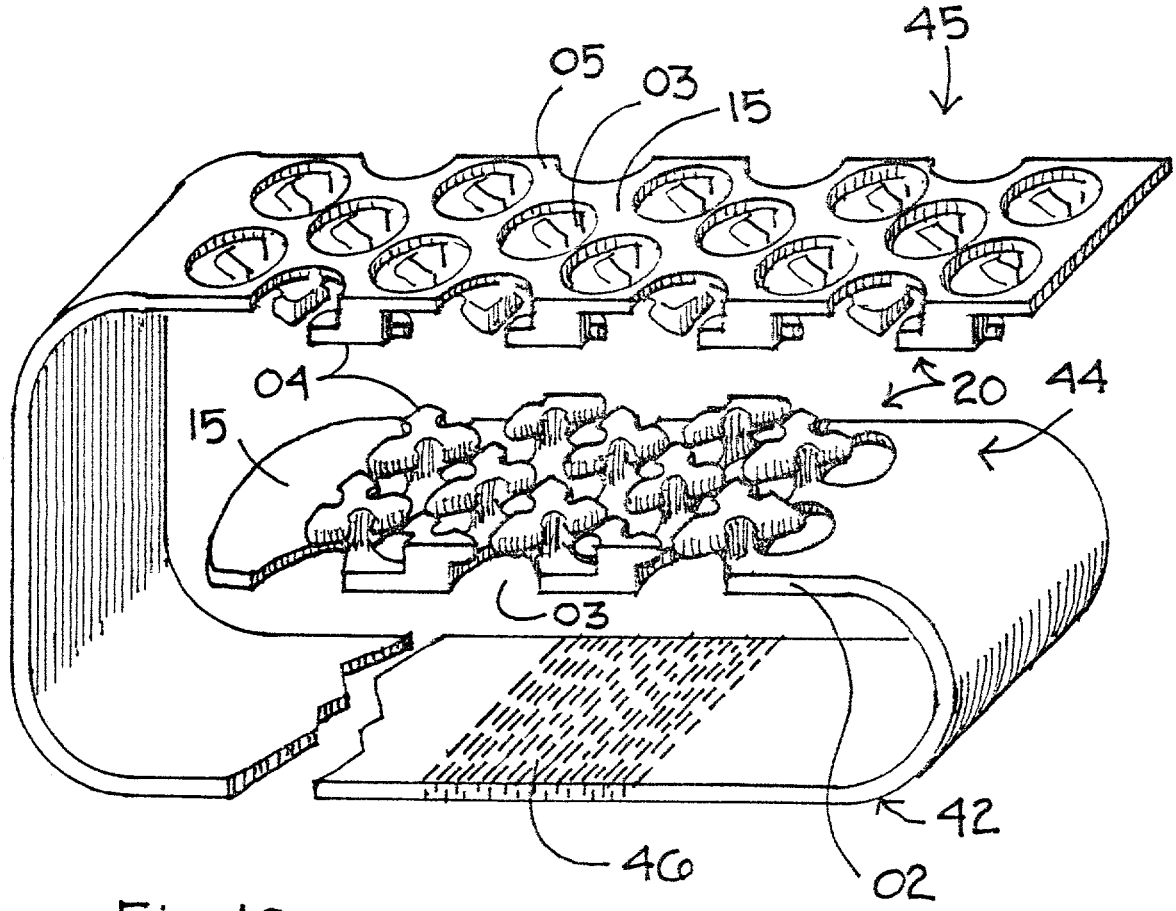

FIG. 10 schematically illustrates fastener portions 20 which are part of a primary product 42, illustrated as a molded strap. Said product 42 is designed to include said fastener portions as an integral part of said product so that when said product is folded toward itself said first and second portions may be adjustably fastened. Said product may include a first portion 44 configured in an upward facing arrangement, and a second portion 45 configured in a downward facing arrangement as illustrated, or may comprise both fastener portions configured in like arrangements. Said product 42 may also optionally comprise a component having a third portion spaced from a fourth portion, wherein the first portion 44 is contained in said third portion and the second portion 45 is contained in said fourth portion. Said product 42 may include an optional elastic segment 46, designed to allow said second part 45 to be stretched prior to fastening so as to provide said relative shearing force as needed to slidingly engage the portions by the inherent elasticity of said elastic segment. It is important to note that virtually any type of improved slidingly engagable fastener may be readily substituted in a product in lieu of the triangular design illustrated. Likewise, it should be noted that a slidingly engagable fastener portion may be integrally molded or formed as part of a wide variety of primary products or components, and that such fastener portions may be utilized for component assembly or as a functional sub-part of such a product or component.

Figure 11:
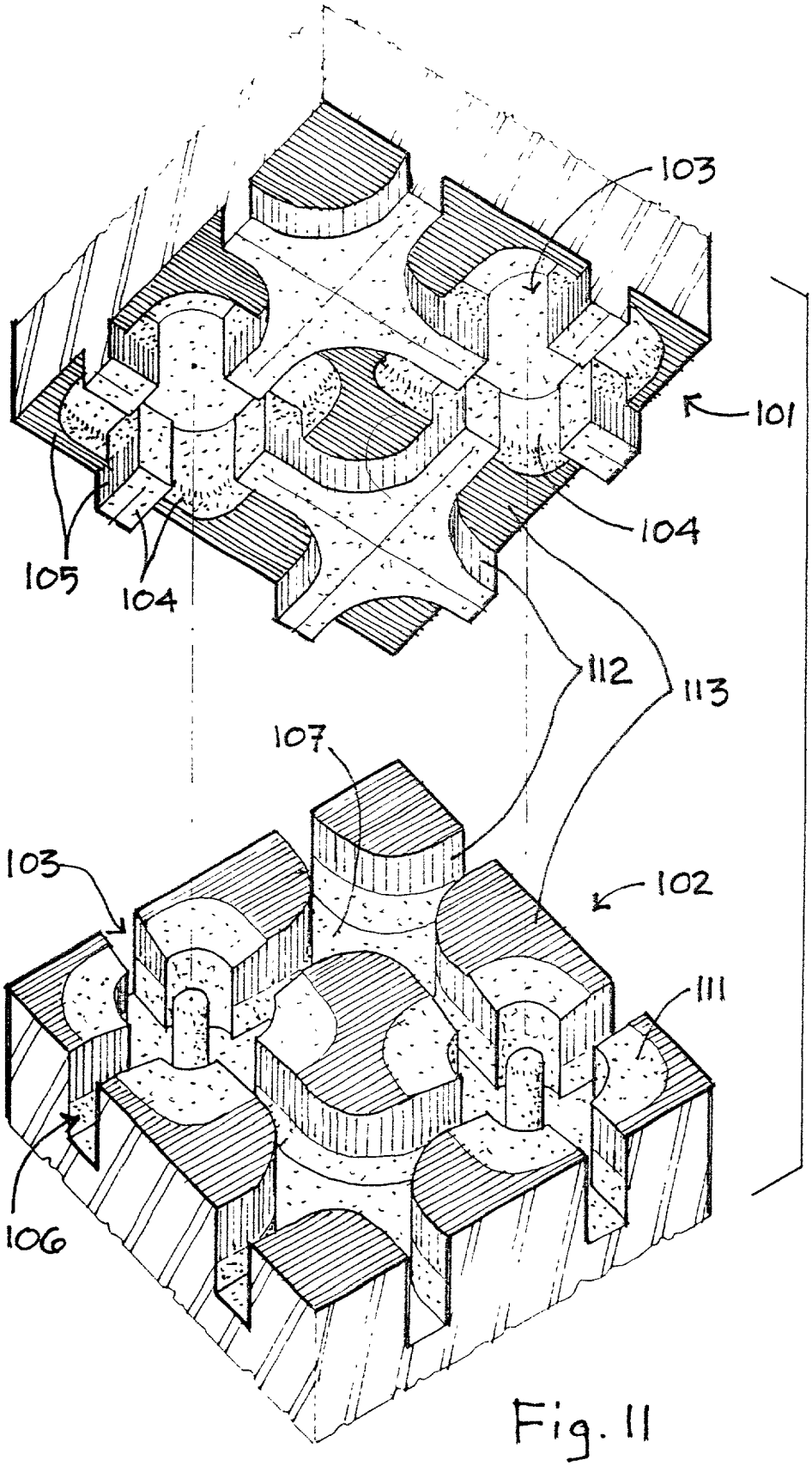
FIG. 11 Schematic perspective illustrating portions of two dies designed to produce a multi-directional SEF portion FIG. 12 Schematic perspective illustrating portions of two dies designed to produce a uni-directional SEF portion FIG. 13 Schematic sectional view illustrating portions of two dies designed to produce a product incorporating two SEF portions FIG. 14 Schematic sectional view illustrating portions of two dies designed to produce a double sided SEF portion FIG. 15 Schematically illustrates in sectional view a reciprocating molding apparatus which includes a die set FIG. 16 Schematically illustrates in sectional view a rotating cutting/bending apparatus including a die set FIG. 17 Schematically illustrates in sectional view a rotating cutting/bending apparatus including a die set FIG. 18 Schematically illustrates in sectional view a continuous molding apparatus including rotating molds incorporating a die set

A Method for producing Improved Slidingly Engagable Fastening Devices of various types includes the provision of a set of interengaging dies and an apparatus for engaging such dies in order to cause a material inserted or injected into a cavity provided by such dies to take the desired form of such fastening device, as further described below. FIG. 11 schematically illustrates a portion of such a set of dies designed to produce a molded fastener portion of the type 01 shown in FIG. 1, however it should be emphasized that the subject method may be applied to improved fastener embodiments of any type in a wide range of materials.

With reference to FIG. 11, a first die 101 comprises a plurality of cavities 103 and includes surface segments 104 which are cavity walls, and other surface segments 105 which provide gates defining fenestrations 03 in the resultant product 01. A second die 102 also comprises said plurality of cavities 103 and includes surface segments 107 which also are cavity walls, other surface segments 108 providing gates, and also includes surface segments 111 which are cavity walls defining the undersides 10 of the resultant product 01. Said gates 105 include a contact surface which is designed to engage with a contact region of said gates 108 when said first and second dies are intermeshed so as to define fenestrations 03, wherein ones of such fenestrations are at least partially aligned with ones of undersides 10 of said product in a direction perpendicular to base structure 02. When said first and second dies are engaged by an appropriate apparatus, said cavities 103 are interconnected so as to define the common fenestrated base structure 02 of said product as well as integral stems, islands and surface features. Said first and second dies may also typically include a perimeter gate and other aspects necessary for production known to industry which are not herein claimed.

It can be appreciated from FIG. 11 that said cavities 103 include cross sections which are contiguous and other cross sections which are not contiguous. Said gates 105, 108 are designed to engage each other so as to effect interfacing gates of a first type 112 which are substantially parallel to the molding axis (that is, perpendicular to the interfacing plane of each said die). Typically the walls of said gates of this first type are slightly inclined relative to the molding axis to allow molds to release without lockup. When said first and second dies are engaged, certain of such gates of the first type 112 effectively define a second cavity 106 which is located within the somewhat larger first cavity 103 occurring when said first and second molds are not engaged. In addition, said surface segments 105, 108 may also be designed to engage each other in a juxtaposition which is substantially perpendicular to the molding axis so as to effect interfacing gates of a second type 113, thereby precisely defining the depth of said cavity 103 and therefore defining the thickness of said base structure 02 and the associated structure. Said cavity 103 may be filled with a thermoplastic resin or other moldable material so as to provide a molded product, using technology known to industry.

Referring back to FIG. 1, it should be noted that said fenestrated base structure 02 of said product 01, as defined by said cavity 103, includes fenestrations that align, in a direction generally perpendicular to said fenestrated base structure, with said undersides 10 and also include additional fenestrated areas 114 which do not align in such direction with said undersides. Such additional fenestrated areas allow a product to be designed to provide maximum economy of material and to enhance the flexibility of said product as may be desired for certain applications. Said additional fenestrated areas 114 also allow said dies to include interfacing gates of type 113 as described above, so as to precisely control the relative thickness of said product. Said additional fenestrated areas 114 may also be incorporated to enhance function by receiving the conical protrusions 14 of corresponding islands, to provide means for attachment (as by sewing), to provide aesthetic effect, or to otherwise enhance said product.

As apparatus of diverse generic types, as schematically illustrated in FIGS. 15-18, is provided to align, interengage, and pressurize said first and second dies 101, 102. When said first and second dies are caused to align and interengage by such an apparatus, said cavity 103 is provided having sidewalls which generally coincide with the surface of the desired product (such as 01). When a flowable or malleable substance is inserted between said first and second dies, said apparatus causes pressure to be exerted on such substance within said cavity so that such substance is forced to take the general form of said cavity 103, thereby providing said product. Such substance may be a moldable material such as thermoplastic resin or fibrous slurry. Alternatively, when the product is of a design that includes a generally consistent thickness, said substance may be a malleable material such as sheet metal, formable plastic, paper, composite material, or paperboard. In the former instance, said moldable substance is generally injected under pressure and is intended to completely fill said cavity 103. In the latter instance, said malleable material is intended to take the approximate shape of said cavity 103 but does not necessarily fill said cavity completely.

Figure 12:
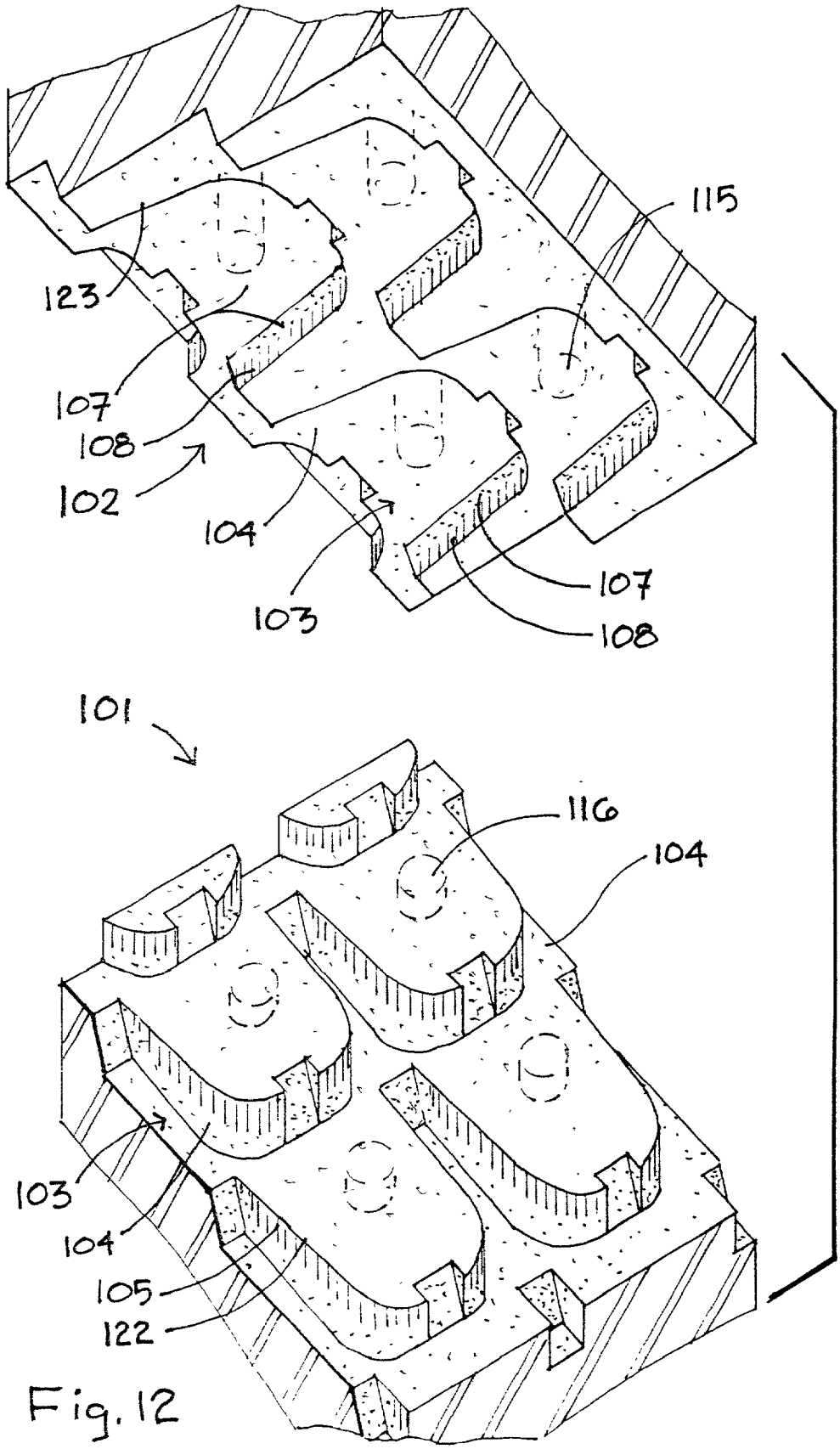

FIG. 12 illustrates a set of dies designed to produce a directionally oriented slidingly engagable fastener of the stepped type 25 as seen in FIG. 5 above. A first die 101 includes cavities 103, cavity walls 104, and surface segments which define perforations 105. A second die 102 includes cavities 103, cavity walls 107, and other surface segments which define perforations 108. Said first and second dies may be included in an apparatus designed for molding so that said cavities 103 may be filled with a moldable substance to provide a fastener portion 25, as in the previous example. Alternatively, it will be noted that said Slidingly Engagable Fastener Portion 25 as well as other embodiment types are of a design which can also be produced by forming a malleable sheet material such as paper or sheet metal, depending only on the general type of apparatus chosen and specific design of said dies as to hardness, scale, etc. Where the subject method is utilized to form a product of a such malleable materials, at least one of said first and second dies generally includes a plurality of punching segments each having a punching surface and a plurality of edge segments having cutting edges 122 and the other of said dies generally includes edge segments providing complementary anvils 123. It should be noted that the subject method used to produce such "formed" fastening portions has significant utility, providing on one hand an inexpensive means of producing relatively strong sheet metal fasteners for use in construction and industry, and on the other hand a range of inexpensive fiber, paper, or biodegradable fasteners for disposable sanitary products, packaging and temporary assembly.

Optionally, one of said first and second dies may also include a plurality of ejection slots 115, each said ejection slots being aligned with a secondary punching segment 116 of the other of said first or second dies, which surface segment is intended to punch through said malleable material so as to eject a part thereof, thereby providing said additional perforated areas 114 as otherwise described above in a molded product. It should be noted that when producing a formed fastener product of a sheet material as in this instance, dies having said interfacing gates of the second type 113 as described above are unnecessary, in that the thickness of material is generally predetermined.

FIG. 13 schematically illustrates a set of said first and second dies as described above which also include aspects defining a another primary product 125 of which two of said fastener portions are an integral part. In this example said primary product might be an elongated plastic strap similar to the embodiment 43 of FIG. 11 (but having fastener portions comprising a quadrille configuration as in embodiment 01) having complementary fastener portions at each end which in this instance are configured in opposing directions and oriented to opposite sides of said product so that one end of the resultant said strap may be adjustably attached to the other. Said interconnected cavities 103 are also interconnected to a primary cavity 126, which defines said product 125. It is important to note that virtually any formable or moldable primary product or component could likewise incorporate a fastener portion as a subsidiary portion of the whole by incorporating a set of dies as herein described as subparts of the dies used to produce such primary product or component.

FIG. 14 schematically illustrates how the subject method may also be utilized to produce double-sided fasteners such as that of type 32 of FIG. 7 above. A set of said first and second dies 101, 102 are substantially identical, each having cavities 103, cavity walls 104, 107, interfacing gates 105, 108 and walls defining undersides 111. Each said die therefore simultaneously defines both a first (upper) basal surface 15 of a fastener with associated islands 04 extending therefrom, and a second (under) basal surface 19 as well as the island undersides 10 of a fastener on a second side of said double-sided fastener.

In each type of apparatus 117 as described herein, said first and second dies also include other aspects common to industry including means for causing properly registered alignment, means for extracting extraneous material, means for ejecting products, means for heating and cooling, and other aspects common to industrial molding and die forming processes which are not claimed as part of the present invention.

Figure 15:
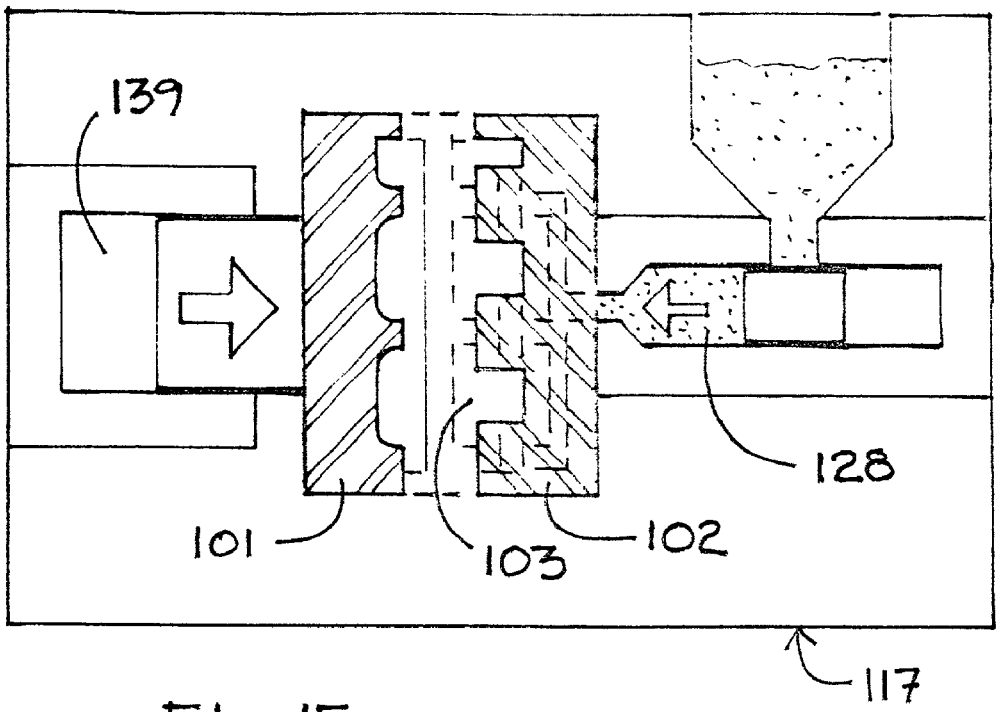

As illustrated schematically in FIG. 15 an apparatus 117, being a simple reciprocating injection molding machine, is provided to first align and intermesh a set of said first and second dies 101, 102 by a known means for providing sequential pressure 139, and to secondly inject a moldable substance 128 into said interconnected cavities 103 by a known means for injecting such a substance under pressure. Said first and second dies may also include known means for introducing and distributing said substance, ejecting air, cooling, and ejecting said product. After said substance is sufficiently hardened, said first and second dies are disengaged by said reciprocating apparatus and said product is ejected by same.

Figure 16:
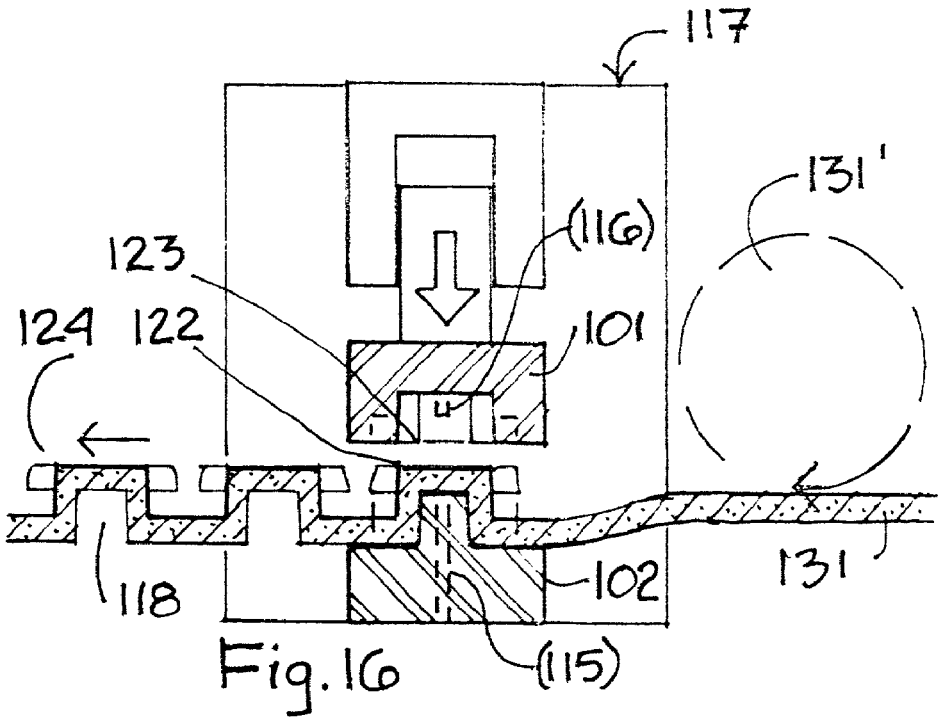

A reciprocating cutting/forming press apparatus 117 is illustrated in FIG. 16. Herein said first 101 and second 102 dies are aligned and intermeshed under pressure so as to form a product 118 out of a malleable sheet material 131 such as sheet metal, paper, or formable plastic. In this instance, one of said first and second dies includes surface segments having a plurality of cutting edges 122 and the other of said first and second dies includes surface segments having a plurality of anvil portions 123 so that said product includes a plurality of cut edges 124, at least some of said cut edges being adjacent to said undersides 10 of said product, and at least some others of said cut edges being adjacent to said perforations 03. Such an apparatus, and said dies may also include means for ejecting excess material such as the ejection slots 115 illustrated in FIG. 12. Said reciprocating press may include mechanisms to assure alignment, provide sequential application of pressure, provide for sequential movement of product, as well as other aspects known to the forming industry. Such a reciprocating cutting/forming press may be designed to provide a sequential (row by row) forming operation as schematically illustrated here or to provide multiple row forming of relatively larger fastener sheets, depending on material used and design criteria. Material may be supplied into such an apparatus or other forming apparatus as individual sheets 131 or from a coil 131'.

Figure 17:
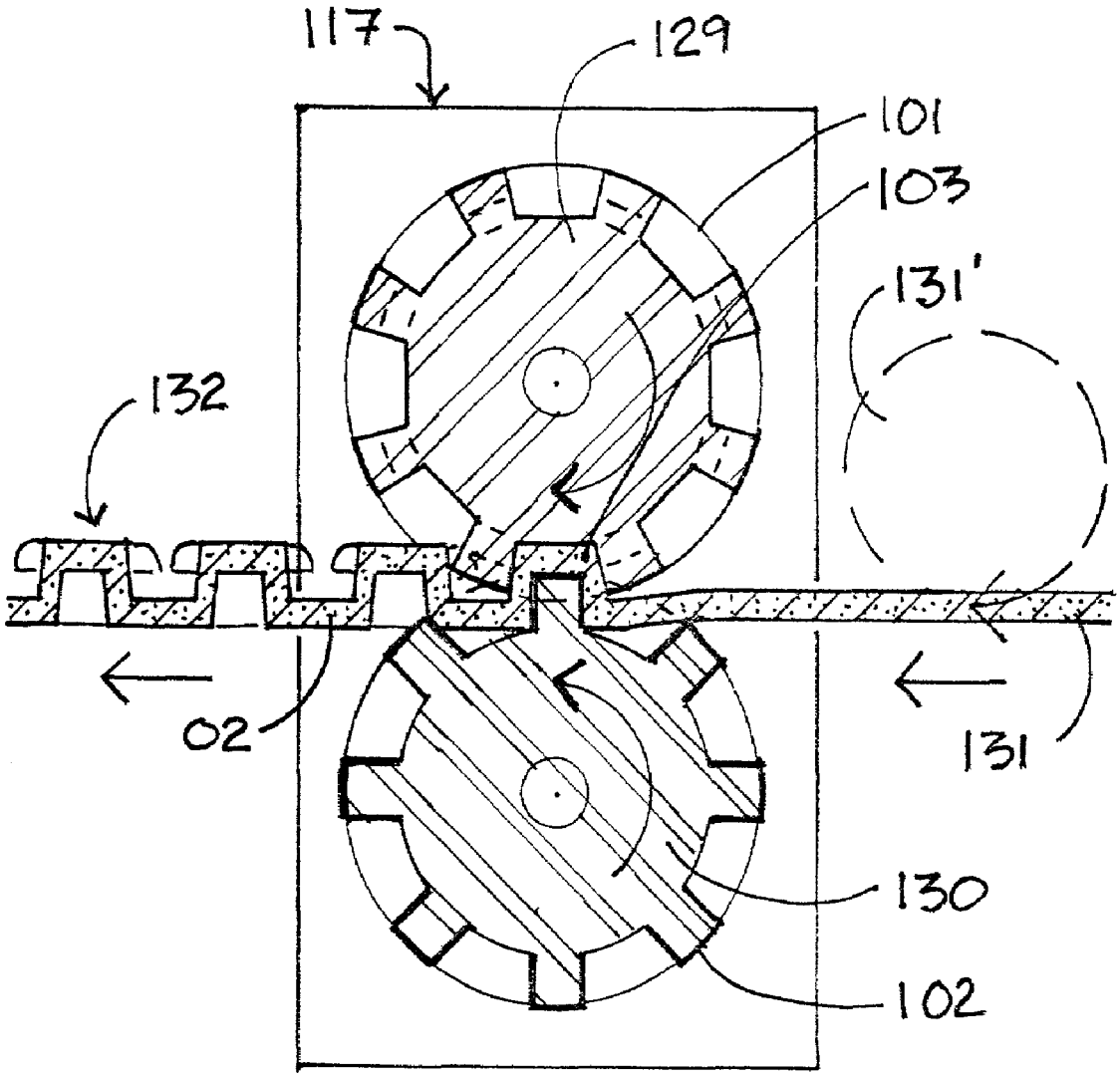

FIG. 17 schematically illustrates a rotating cutting/forming press apparatus 117 having pluralities of said first and second dies 101, 102 arrayed on the surfaces of a set of counter-rotating rollers 129, 130 so that, as a malleable sheet material 131 is inserted between said rollers, it will be continuously formed into a continuous length of fastener product 132. Said malleable material 131 may be provided sequentially in sheet form or continuously in a coil form 131' as illustrated. Said product 132 is then extruded from said rollers in a continuing fashion and may be cut into useable sizes or otherwise modified by subsequent processes known to industry.

Figure 18:
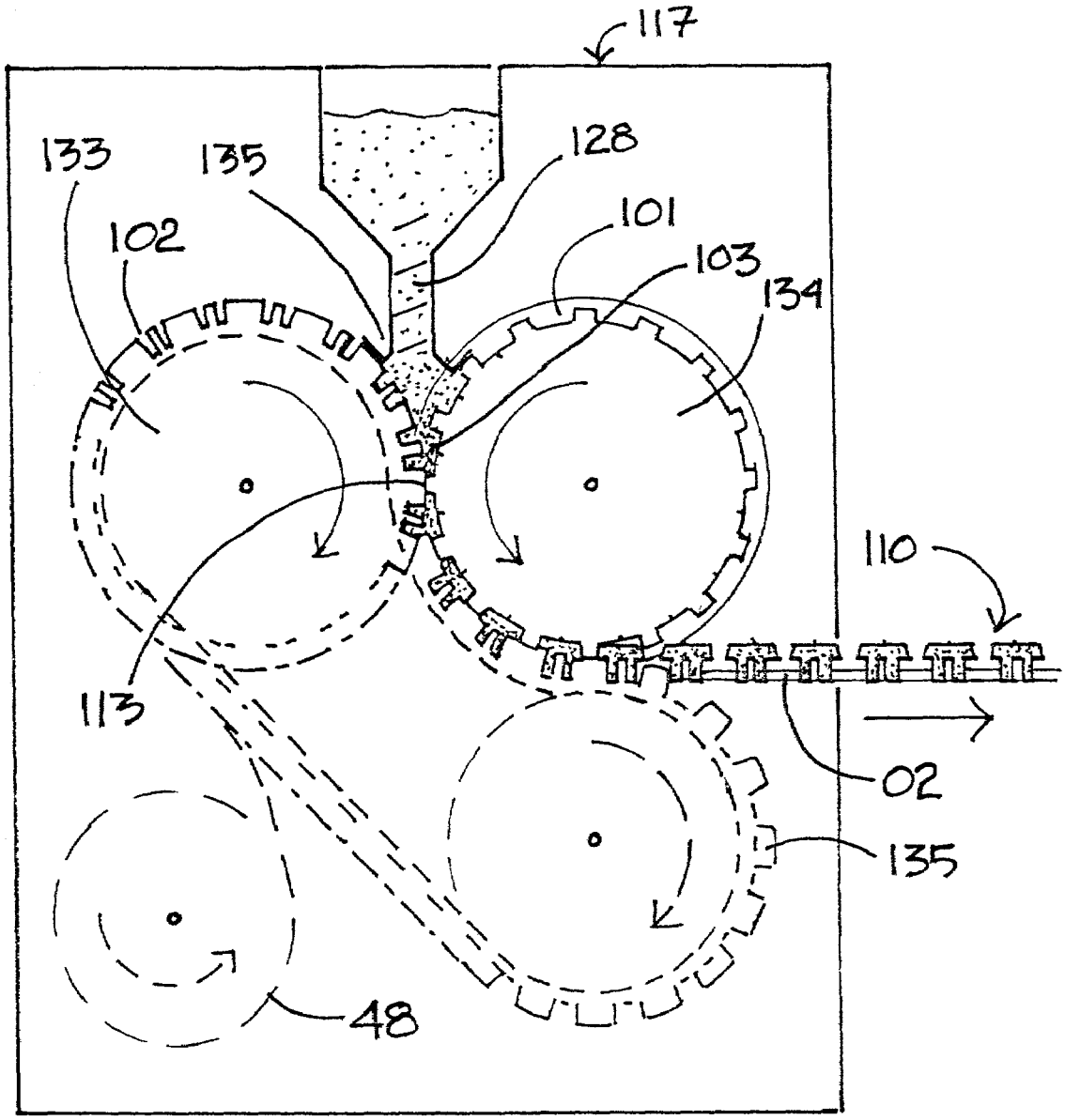

A continuous molding apparatus 117 is schematically illustrated in FIG. 18, wherein said first and second dies 101, 102 are arrayed on the surfaces of a set of rotating molds 133, 134. A flowable molding substance 128 such as thermoplastic resin is inserted through a nip 135 under sufficient pressure to completely fill interconnected cavities 103 as defined by said interengaging dies. Said apparatus includes means for cooling said material as is common to the industry so that said product 110 may be sequentially stripped from the molds as it hardens. An important aspect of such an apparatus is that said interfacing gates of the parallel type 113 serve to define the relative disposition of said first and said molds 133, 134 thereby precisely defining the thickness of said fenestrated base structure 02 as well as individual elements of said product.

At least one of said rotating molds 133, 134 may optionally be provided in the form of a continuous molding belt 135. This option may be included in order to expedite the production process by providing a longer mold contact time for cooling prior to product ejection, thereby allowing said rotating molds to operate at a faster speed.

Optionally, a fabric or other reinforcing material 48 may be integrally molded into said product for the purpose of reinforcing, providing selvage for sewing, or other purpose. Said reinforcing material 48 is temporarily adhered to the peripheral surface of one of said first or second counter rotating molds 133 so that said material is caused to pass through said apparatus as said moldable substance 128 fills said interconnected cavities 103, thence becoming integrally molded with said product. Such a reinforcing material 48 which has perforations which can align with protruding elements of said first or second dies 102 can be caused to substantially attach to said protruding elements prior to the introduction of said substance 128, thereby aligning and registering said substrate 136 with said interconnected cavities 103 between said perforations 109.

It is to be understood that the forgoing description and associated drawings are intended to schematically demonstrate a wide range of embodiments which may be produced by the method described or by other methods. It is the intent of these documents to describe a range of variations which may be modified or combined in diverse ways within the scope of this invention. It is further intended that all matters contained in the foregoing description or shown in the accompanying drawings shall be interpreted as schematically illustrative and not in a limiting sense. The following claims are intended to cover the generic and specific features of the invention herein described, and all statements of the scope of the invention which, as a matter of language, might be said to fall therebetween.

Having thus described the invention, I hereby claim the following:

1. A slidingly engageable fastening device comprising:

a first portion that includes:

a first base having a first basal surface;

and a plurality of first undercut segments spaced from said first basal surface; and a second portion, for slidingly engaging with said first portion upon application of a relative shearing force with respect to said first and second portions, said second portion including:

a second base having a plurality of fenestrations and a second basal surface, said second base continuous between said fenestrations to stem segments, each said stem segment extending away from said second basal surface to the top surface of an island spaced from said second basal surface, each said island having a segmented edge comprising a plurality of second undercut segments, each said second undercut segment extending away from a sidewall of an adjacent said stem segment, so as to overhang at least part of a corresponding said fenestration;

wherein said undercut segments associated with each said island are separated by intervening said stem segments and include undersides spaced from said second basal surface, and wherein edges of said undercut segments are oblique to the edges of said undercut segments associated with adjacent said islands, and further wherein said sidewalls and undersides are configured to provide a generally tapered aperture for progressively receiving adjacent pairs of said first undercut segments between said sidewalls, said undersides, and the plane of said second basal surface, so as to connect and interlock said first portion with said second portion upon application of said relative shearing force.

2. A device as in claim 1, wherein said plurality of first undercut segments are arranged in groups of two in a generally bilateral disposition, said first portion further comprising a plurality of apertures, each of said apertures associated with a corresponding pair of adjacent ones of said first undercut segments, said plurality of apertures for receiving complementary pairs of said plurality of second undercut segments.

3. A device as in claim 1, wherein said plurality of first undercut segments are arranged in groups of three in a generally triangular disposition, said first portion further comprising sets of three apertures, and a plurality of aperture openings each associated with a corresponding one of said sets of three apertures, each of said sets of three apertures and each of said plurality of aperture openings corresponding to a set of three adjacent ones of said first undercut segments, said sets of three apertures for receiving complementary sets of three of said plurality of second undercut segments.

4. A device as in claim 1, wherein said plurality of first undercut segments are arranged in groups of four in a generally quadrille disposition, said first portion further comprising sets of four apertures and a plurality of aperture openings each associated with a corresponding one of said sets of four apertures, each of said sets of four apertures and each of said plurality of aperture openings corresponding to a set of four adjacent ones of said first undercut segments, said sets of four apertures for receiving complementary sets of four of said plurality of second undercut segments.

5. A device as in claim 1, wherein said segmented edges of said islands are configured in a generally hexagonal disposition and said islands are arrayed to provide a plurality of generally hexagonal aperture openings between adjacent groups of three said islands, said aperture openings for accepting sets of at least three said first undercut segments prior to application of said relative shearing force.

6. A device as in claim 1, wherein said plurality of second undercut segments are arranged in groups of two arrayed in a first row generally perpendicular to said force;

and further wherein each said top surface of an island is generally coplanar with a third basal surface of a third fenestrated base, said third base continuous between fenestrations to a plurality of second stem segments extending away from said third basal surface to the segmented top surfaces of a second row of third islands with undercut segments extending over corresponding fenestrations in said third base between said third stem segments;

and further wherein said top surfaces of said third islands are generally coplanar with a fourth basal surface with associated third stem segments extending away from said fourth basal surface to a third row of fourth islands;

thereby effecting a slidingly engaging fastening device with a stepped longitudinal profile.

7. A device as in claim 1, wherein ones of said stem segments associated with each said island are conjoined into contiguous stems and wherein said undercut segments extend away from sidewalls of said stems.

8. A device as in claim 7, wherein ones of said stems are associated with at least three of said second undercut segments.

9. A device as in claim 1, wherein said second basal surface includes a means for diverting said plurality of first undercut segments into engagement with corresponding ones of said apertures.

10. A device as in claim 1, wherein said second basal surface includes a diverting structure that directs said plurality of first undercut segments into engagement with corresponding ones of said apertures.

11. A fastening device according to claim 1 secured to a substrate material, said device also comprising:

a backing structure for confronting said second base and being attachable to said second portion, said backing structure for securing said second portion to the substrate material when said backing structure is attached to said first portion.

12. A fastening device as in claim 11, wherein ones of said islands include receptors having corresponding receptor openings located on a third basal surface opposite said second basal surface, and wherein said backing structure comprises a set of pins corresponding to said receptors.

13. A method of fastening two portions comprising the steps of:

providing the slidingly engageable fastening device of claim 1;

arranging said first and second portions so that at least one pair of said first undercut segments is aligned with at least one of said apertures; and applying said relative shearing force to said first and second portions so as to cause said first undercut segments to be slidingly engaged with said apertures.

14. A device as in claim 1, wherein the top surfaces of said islands and said second basal surface are visible from a first location remote from said top surfaces, and said undercut segments and a third basal surface, opposite said second basal surface, are visible from a second location remote from said second surface.

15. A device as in claim 1 also comprised of a singular thermoplastic entity.

16. A device as in claim 1 also comprised of a singular metal entity.

17. A device as in claim 1 also comprised of a singular fibrous material.

18. A device as in claim 1 also comprised of a composite material.

19. A device as in claim 1 also comprised of a singular thermoset plastic entity.

20. A slidingly engageable fastening device operable upon application of a relative shearing force, including:

a first portion comprising at least one first island spaced from a first base;

and a second portion comprising:

a plurality of second islands each including:

a top surface with a segmented edge, a plurality of undercut segments with undersides extending to said segmented edge, and a plurality of stem segments located between said undercut segments;

and a fenestrated second base structure which includes:

a basal surface and a plurality of fenestrations, with sectors of said second base structure extending between said fenestrations and connecting with said stem segments;

wherein said stem segments extend away from said basal surface to said top surface, and said undercut segments are spaced from said basal surface and extend sway from sidewalls of said stem segments so as to overhang corresponding said fenestrations;

and further wherein said sidewalls of said stem segments and said undersides of said undercut segments effect a plurality of generally tapered apertures between said undersides and the plane of said basal surface for progressively receiving and slidingly engaging with said at least one first island upon application of said relative shearing force.

21. A device as in claim 20, wherein a plurality of said at least one first islands and said plurality of second islands are each configured in a generally bilateral disposition, said first portion further comprising a plurality of first apertures each defined by a corresponding pair of adjacent ones of said plurality of first islands and said second portion further comprising a plurality of second apertures each defined by a corresponding pair of adjacent ones of said plurality of second islands.

22. A device as in claim 20, wherein a plurality of said at least one first islands and said plurality of second islands are each configured in a generally triangular disposition, said first portion further comprising a plurality of first aperture openings each defined by three corresponding adjacent ones of said plurality of first islands and said second portion further comprising a plurality of second aperture openings each defined by three corresponding adjacent ones of said plurality of second islands.

23. A device as in claim 20, wherein a plurality of said at least one first islands and said plurality of second islands are each configured in a generally quadrille disposition, said first portion further comprising a plurality of first aperture openings each defined by four corresponding adjacent ones of said plurality of first islands and said second portion further comprising a plurality of second aperture openings each defined by four corresponding adjacent ones of said plurality of second islands.

24. A device as in claim 20, wherein a plurality of said at least one first island and said plurality of second islands are each configured in a generally hexagonal disposition, said first portion further comprising a plurality of first aperture openings each defined by three corresponding adjacent ones of said plurality of first islands, and said second portion further comprising a plurality of second aperture openings each defined by three corresponding adjacent ones of said plurality of second islands.

25. A device as in claim 20, wherein said plurality of second islands are arrayed in a first row and wherein said basal surface is generally coplanar with island top surfaces of a second row of islands adjacent said first row; and further wherein said top surfaces of said plurality of second islands are generally coplanar with a third basal surface associated with a third row of islands adjacent said first row.

26. A double-sided interlocking fastening device, comprising: the slidingly engageable fastening device according to claim 20, wherein said second portion also include a plurality of third islands each having a top surface with a segmented edge, a plurality of undercut segments with undersides extending to said edge overhanging portions of said fenestrations, and a plurality of stem segments extending from the top surface of said third islands to a second basal surface of said second base structure, said third islands configured to define a plurality of generally tapered apertures between sidewalls of said stem segments, said undersides, and the plane of said second basal surface.

27. A device as in claim 26, wherein said first islands and said second and third islands are each configured in a generally bilateral disposition, said first islands configured to define a plurality of first apertures each defined by a corresponding pair of adjacent ones of said first islands and said second and third islands defining a plurality of second apertures each defined by a corresponding pair of adjacent ones of said second and third islands.

28. A device as in claim 26, wherein said first islands and said second and third islands are each configured in a generally triangular disposition, said first islands defining a plurality of first apertures each defined by corresponding adjacent ones of said first islands and said second and third islands defining a plurality of second apertures each defined by corresponding adjacent ones of said second and third islands.

29. A device as in claim 26, wherein said first islands and said second and third islands are each configured in a generally quadrille disposition, said first islands defining a plurality of first apertures each defined by corresponding adjacent ones of said first islands and said plurality of second and third islands defining a plurality of second apertures each defined by corresponding adjacent ones of said second and third islands.

30. A device as in claim 26, wherein said first islands and said second and third islands are each configured in a generally hexagonal disposition, said first islands defining a plurality of first apertures each defined by corresponding adjacent ones of said first islands and said second and third islands defining a plurality of second apertures each defined by corresponding adjacent ones of said second and third islands.

31. A device as in claim 26 wherein the top surfaces of said first islands, said first basal surface, and undersides of said second islands are visible from a first location remote from said first islands; and the top surfaces of said second islands, said second basal surface, and undersides of said first islands are visible from a second location remote from said second islands.

32. A slidingly engageable fastening device as in claim 20 also comprising:

a second basal surface opposite said first basal surface and a plurality of attachment devices extending away from said second basal surface.

33. A slidingly engageable fastener as in claim 32, wherein said plurality of attachment devices is a set of nail-like devices.

34. A slidingly engageable fastener as in claim 32 wherein said plurality of attachment devices is a set of riveting devices.

35. A slidingly engageable fastener as in claim 32, wherein said plurality of attachment devices is a set of expansion devices.

36. A sligingly engageable fastener as in claim 32, wherein said plurality of attachment devices is a set of friction fitting devices.

37. A slidingly engageable fastener as in claim 32, wherein said plurality of attachment devices is a set of folding devices.

38. A product, comprising:

a slidingly engageable fastening device according to claim 20 wherein said first portion is located at a first segment of said product and said second portion is located at a second segment of said product remote from said first segment.

39. A product as in claim 38, wherein said first base is contiguous with said second base structure, and said at least one first island is spaced from a second surface of said first base opposite said basal surface of said second base structure.

40. A product as in claim 39 wherein said product includes an elastic section located between said first and second portions.

41. A product as in claim 39, wherein said second surface is opposite said basal surface and said first portion is located remote from said second portion thereby providing a self engaging strap.

42. A product as in claim 38 comprising two or more components wherein said first and second portions are located on diverse ones of said two or more components.

43. A product as in claim 38 wherein said first portion and said second portion are integral components of a singular structural entity.

44. An interlocking device for slidingly engaging a plurality of first islands, comprising:

a base having a plurality of fenestrations and a basal surface; and a plurality of second islands, each said second island comprising a plurality of undercut segments spaced from said basal surface and overhanging corresponding fenestrations, said undercut segments separated by stem segments so as to effect an island top surface with a segmented edge attached to said base by said stem segments;

thereby defining a plurality of apertures for receiving said plurality of first islands, each of said plurality of second islands including at least three undercut segments spaced from one another, wherein said undercut segments are aligned in a direction perpendicular to said basal surface with at least part of ones of said fenestrations.

45. An interlocking device for slidingly engaging a plurality of first islands, comprising:

a base having a plurality of fenestrations and a basal surface; and a plurality of second islands attached to said base and defining a plurality of generally tapered apertures between adjacent pairs of said islands and the plane of said basal surface for receiving said plurality of first islands, each of said plurality of second islands including undercut segments spaced from one another by a plurality of intermediary stem segments extending away from said base to the top surface of each of said second islands;

wherein each of said undercut segments extend over at least some of said plurality of fenestrations.

* * * * *